US006025012A

United States Patent [19]

Matsuda et al.

[11] Patent Number: 6,025,012

[45] **Date of Patent: *Feb. 15, 2000**

[54] METHOD AND APPARATUS FOR DETERMINING FILM THICKNESS CONTROL CONDITIONS AND DISCHARGING LIQUID TO A ROTATING SUBSTRATE

[75] Inventors: Naoko Matsuda, Hirakata; Hiroyuki Naka, Osaka; Motoaki Kamihara, Neyagawa; Osamu Hirota, Kodoma; Keinosuke Kanashima, Osaka; Hiroshi Ogura, Machida, all of Japan

[73] Assignee: Matsushita Electric Industrial Co., Ltd., Osaka-fu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/716,068

[22] Filed: Sep. 19, 1996

[30] Foreign Application Priority Data

Sep. 20, 1995 [JP] Japan ..... 7-241119
Sep. 20, 1995 [JP] Japan ..... 7-241121

[51] Int. Cl.[7] ..... B05D 3/12; B05C 11/02

[52] U.S. Cl. ..... 427/9; 427/240; 118/712; 118/52; 118/667

[58] Field of Search ..... 427/240, 9; 118/712, 118/52, 667

[56] References Cited

U.S. PATENT DOCUMENTS 5,127,362 7/1992 Iwatsu et al. ..... 118/52
5,250,116 10/1993 Tanimoto ..... 118/52

FOREIGN PATENT DOCUMENTS 59-151424 8/1984 Japan .
63-301520 12/1988 Japan ..... 118/52
3-178123 8/1991 Japan ..... 118/52
5-269425 10/1993 Japan ..... 118/52

*Primary Examiner*—Katherine A. Bareford
*Attorney, Agent, or Firm*—Wenderoth, Lind & Ponack, L.L.P.

[57] ABSTRACT

The present invention provides an apparatus which is capable of discharging a process liquid to a rotating substrate at a very constant rate irrespective of variations in the state of the process liquid. A process liquid is discharged toward a rotating substrate by nozzles which are moved from inner to outer radius sides of the rotating substrate. The present invention further provides a method in which film thickness control conditions are determined based on a simulation of a behavior of a process liquid on a substrate.

9 Claims, 17 Drawing Sheets

13
5
14
7
17a
CONTROLLER
17b
18a
18
ABSOLUTE HEIGHT (MEASURED AT INITIAL POSITION)
18c
18d
18c
18b
18e
80
18f
MOTOR ROTATION CONTROLLER 102
101
103
104
KEYBOARD
CRT
COMPUTER
105
EXTERNAL STORAGE DEVICE
RS232C
106
120
RS232C
118
111
110
112
5
INPUT KEYS
PROCESS LIQUID FEEDER
113
11
VARIOUS SENSORS
SUBSTRATE ROTATING MOTOR
115
25
OTHER INPUT/ OUTPUT DEVICES
CONTROLLER
HEAD MOVING MOTOR
70
117
HEATER
CONTROL CONDITION STORAGE
18e
MOTOR FOR LIFTER

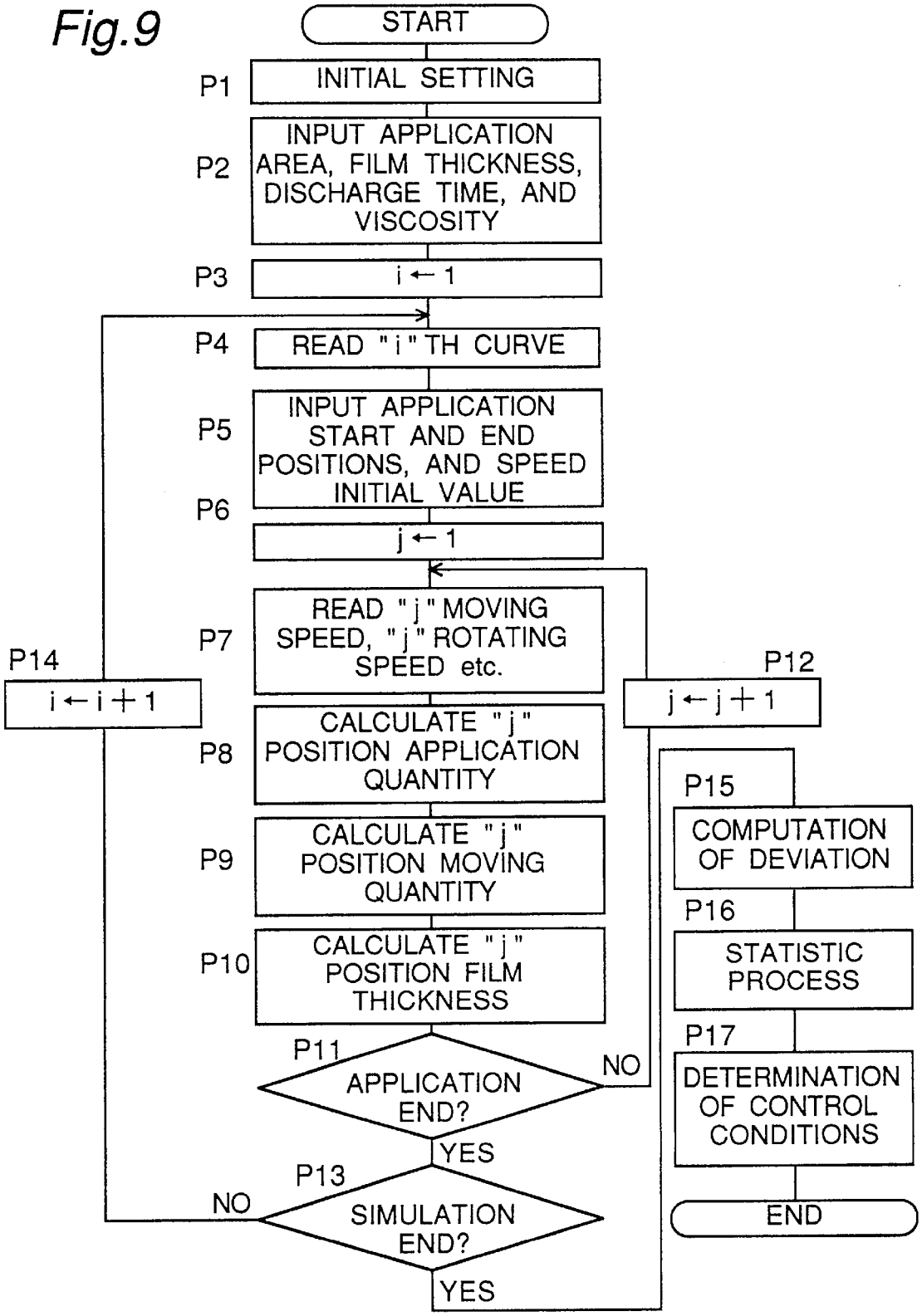
Fig.9
START
P1
INITIAL SETTING
P2
INPUT APPLICATION AREA, FILM THICKNESS, DISCHARGE TIME, AND VISCOSITY
P3
i ← 1
P4
READ "i" TH CURVE
P5
INPUT APPLICATION START AND END POSITIONS, AND SPEED INITIAL VALUE
P6
j ← 1
P7
READ "j" MOVING SPEED, "j" ROTATING SPEED etc.
P8
CALCULATE "j" POSITION APPLICATION QUANTITY
P9
CALCULATE "j" POSITION MOVING QUANTITY
P10
CALCULATE "j" POSITION FILM THICKNESS
P11
APPLICATION END?
NO
YES
P12
j ← j + 1
P13
SIMULATION END?
NO
YES
P14
i ← i + 1
P15
COMPUTATION OF DEVIATION
P16
STATISTIC PROCESS
P17
DETERMINATION OF CONTROL CONDITIONS
END

METHOD AND APPARATUS FOR DETERMINING FILM THICKNESS CONTROL CONDITIONS AND DISCHARGING LIQUID TO A ROTATING SUBSTRATE

BACKGROUND OF THE INVENTION

The present invention relates to a film forming apparatus and a method for determining film thickness control conditions used in the apparatus. The film forming apparatus is used for forming a film of a desired thickness by discharging a process liquid toward a rotating substrate such as optical disk substrates, liquid crystal substrates, and semiconductor substrates, while moving the nozzle, e.g., from an inner radius side to an outer radius side of the rotating substrate.

Conventionally, for the formation of a resist film or other film on a liquid crystal substrate, optical disk substrate, semiconductor substrate, or other substrates by applying thereto a process liquid, such as photoresist, there have been used film forming apparatuses in which the substrate is rotated during the forming of the film.

In this kind of film forming apparatus, there is known an apparatus which comprises a substrate holder for rotating and holding the substrate, a process liquid discharger having a nozzle for discharging the process liquid to the substrate held by the substrate holder, and a process liquid feeder for feeding the process liquid to the process liquid discharger. In order for this film forming apparatus to attain an uniform film thickness, the process liquid needs to be dispensed at the most constant possible rate through the nozzle. For this purpose, the process liquid feeder is arranged so as to pressurize the process liquid at a constant pressure when feeding it to the process liquid discharger.

With this conventional arrangement, since temperature variations of the process liquid causes viscosity variations, the process liquid, even if fed at a constant pressure to the process liquid discharger, might not be discharged at a constant quantity from the nozzle of the process liquid discharger. Pressure variations due to the liquid level being lowered by the consumption of the process liquid may also hinder the process liquid from being discharged at a constant quantity from the process liquid discharger. In such cases, the conventional arrangement has a drawback in that the discharge velocity of the process liquid from the nozzle may vary with variations in the state of the process liquid.

In this film forming apparatus, since the process liquid is applied with the substrate being rotated, the application area of the process liquid increases more rapidly towards the peripheral side of the substrate. Accordingly, in order to attain a uniform film thickness, such control is implemented such that as the discharge head moves toward the peripheral side, the moving speed of the discharge head or the rotational speed of the substrate is decreased, or the flow velocity of discharge from the nozzle is gradually increased.

For this control, control conditions necessary to obtain a desired film thickness, such as the head moving speed or discharge flow velocity or number of revolutions of the substrate, that vary among different radial positions and such control conditions have conventionally been determined by executing actual application processes under the control conditions obtained by rule of thumb and by measuring the resulting film thickness using trial and techniques.

With this conventional arrangement, since the control conditions for forming a desired film thickness are determined by executing actual applications and by measuring the resulting film thicknesses, it would take long time to determine the control conditions. Also, since the control conditions are determined by actual measurements, the determined control conditions are not necessarily be optimum ones, such that the limits for the film thickness control could not be defined. For example, in the case where the control conditions are determined by trial and error, when the resulting film thickness is different from the desired film thickness by 1% or so, it could not be decided whether the resultant film thickness is the limit of control, or it could be made even closer to the desired film thickness.

SUMMARY OF THE INVENTION

An object of the present invention is to provide a film forming apparatus which is capable of discharging the process liquid to the substrate at the most constant possible rate irrespective of variations in the state of the process liquid.

An object of the present invention is to provide a method for determining film thickness control conditions for obtaining an optimum film thickness in a short amount of time in forming a film of a desired film thickness by discharging a process liquid to a rotating substrate. Another object is to provide a film forming apparatus capable of forming a film of a desired film thickness under optimum control conditions by using the method of the present invention.

In order to accomplish these and other objects, according to a first aspect of the present invention, there is provided a film forming apparatus for forming a film of a film thickness on a substrate by discharging a process liquid toward the substrate, the film forming apparatus comprising:

substrate holding means for holding the substrate;

process liquid discharging means for discharging the process liquid toward the substrate held by the substrate holding means;

process liquid feeding means for feeding the process liquid to the process liquid discharging means;

state detecting means for detecting a state of the process liquid; and liquid quantity control means for controlling a process liquid feed quantity from the process liquid feeding means to the process liquid discharging means responsive to a detection result by the state detecting means so that a discharge quantity of the process liquid from the process liquid discharging means falls within a specified range.

In this case, since the feed quantity of the process liquid is controlled responsive to the state of the process liquid, the process liquid can be discharged to the substrate at the most constant possible rate irrespective of variations in the state of the process liquid.

According to a second aspect of the present invention, there is provided the film forming apparatus as defined in the first aspect, wherein the state detecting means is temperature detecting means for detecting a temperature of the process liquid discharged from the process liquid discharging means, and the liquid quantity control means controls the process liquid feed quantity from the process liquid feeding means to the process liquid discharging means responsive to the temperature of the process liquid detected by the temperature detecting means.

In this case, since the feed quantity of the process liquid is controlled responsive to the temperature of the process liquid, the process liquid can be discharged to the substrate at the most constant possible rate irrespective of variations in the temperature of the process liquid.

According to a third aspect of the present invention, there is provided the film forming apparatus as defined in the first aspect, wherein the process liquid feeding means comprises a process liquid reservoir which serves for storing the process liquid and which is movable up and down, and a pressurizing gas feeder for pressurizing the process liquid stored in the process liquid reservoir, the state detecting means is liquid level detecting means for detecting a liquid level height of the process liquid in the process liquid reservoir, and the liquid quantity control means controls vertical position of the process liquid reservoir responsive to a detection result of the liquid level detecting means so that the liquid level height of the process liquid from a reference position outside the process liquid reservoir falls within a specified range.

In this case, since the vertical position of the process liquid reservoir is controlled so that the liquid level height of the process liquid from the reference plane for the process liquid falls within the specified range, the liquid level height of the process liquid from the reference plane is maintained within the specified range even if the liquid level of the process liquid in the process liquid reservoir has lowered due to the consumption of the process liquid. Thus, the process liquid can be discharged to the substrate at the most constant possible rate irrespective of the process liquid consumption.

According to a fourth aspect of the present invention, there is provided the film forming apparatus as defined in the first aspect, wherein the process liquid feeding means comprises a process liquid reservoir for storing the process liquid, a pressurizing gas feeder for pressurizing, with pressurizing gas, the process liquid stored in the process liquid reservoir, and a process liquid replenisher for replenishing the process liquid to the process liquid reservoir, the state detecting means is liquid level detecting means for detecting a liquid level height of the process liquid in the process liquid reservoir, and the liquid quantity control means controls a replenishment quantity of the process liquid from the process liquid replenisher to the process liquid reservoir so that the liquid level height of the process liquid in the process liquid reservoir detected by the liquid level detecting means falls within a specified range.

In this case, since the process liquid is replenished when the liquid level of the process liquid has lowered, the liquid level of the process liquid in the process liquid reservoir is maintained within the specified range. Thus, the process liquid can be discharged to the substrate at the most constant possible rate.

According to a fifth aspect of the present invention, there is provided the film forming apparatus as defined in the first aspect, wherein the process liquid feeding means comprises a process liquid reservoir for storing the process liquid, and a pressurizing gas feeder for pressurizing, with pressurizing gas, the process liquid stored in the process liquid reservoir, the state detecting means is liquid level detecting means for detecting a liquid level height of the process liquid in the process liquid reservoir, and the liquid quantity control means controls pressure of the pressurizing gas by controlling the pressurizing gas feeder responsive to the liquid level height of the process liquid in the process liquid reservoir detected by the liquid level detecting means.

In this case, the pressure of the pressurizing gas is increased so that the pressure that lowers with increasing water heads of the process liquid discharging means and the liquid level of the process liquid due to decreases in the liquid level of the process liquid is compensated. Thus, the process liquid can be discharged to the substrate at the most constant possible rate.

According to a sixth aspect of the present invention, there is provided the film forming apparatus as defined in the first aspect, further comprising moving means for moving the process liquid discharging means relative to the substrate.

In this case, the process liquid can be applied to larger substrates.

According to a seventh aspect of the present invention, there is provided the film forming apparatus as defined in the first aspect, further comprising substrate rotating means for rotating the substrate holding means.

In this case, the process liquid can be applied to the substrate at higher speeds.

According to an eighth aspect of the present invention, there is provided the film forming apparatus as defined in the first aspect, wherein the process liquid discharging means has a plurality of process liquid dischargers disposed in array in one direction.

According to a ninth aspect of the present invention, there is provided the film forming apparatus as defined in the eighth aspect, wherein the process liquid dischargers are nozzles of an ink jet system.

According to the present invention, since the feed quantity of the process liquid is controlled responsive to the state of the process liquid, such as temperature and liquid level, the process liquid can be discharged at the most constant possible rate irrespective of variations in the state of the process liquid.

In order to achieve the above objects, according to a tenth aspect of the present invention, there is provided a method for determining film thickness control conditions, by which control conditions for forming a film into a film thickness are obtained in a film forming apparatus for forming a film of a film thickness on a substrate by discharging a process liquid toward the substrate while nozzles are moved along a moving direction on the rotating substrate, the method comprising:

an information acceptance step for accepting two kinds of information on the film thickness and viscosity of the process liquid;

simulation steps for, based on the two kinds of information accepted at the information acceptance step, varying at least one of a number of revolutions of the substrate, a rotation duration time of the substrate, a moving speed of the nozzles, a discharge flow velocity of the nozzles, and a temperature of the process liquid gradually in each of classified unitary positions along the moving direction, simulating behavior of the process liquid on the substrate, and calculating film thicknesses for the classified positions; and control condition determination steps for, responsive to a film thickness calculation result of the simulation steps, obtaining the control conditions that at least any one of the number of revolutions of the substrate, the rotation duration time of the substrate, the moving speed of the nozzles, the discharge flow velocity of the nozzles, and the temperature of the process liquid is varied.

According to an eleventh aspect of the present invention, there is provided the method for determining film thickness control conditions as defined in the tenth aspect, wherein the information acceptance step includes accepting two kinds of information on nozzle discharge time and application area of the process liquid in addition to the two kinds of information on the film thickness and the viscosity of the process liquid; and the simulation steps include, based on the four kinds of information accepted at the information acceptance step, varying at least one of the number of revolutions of the substrate, the rotation duration time of the substrate, the moving speed of the nozzles, the discharge flow velocity of the nozzles, and the temperature of the process liquid gradually in each of classified unitary positions along the moving direction, simulating the behavior of the process liquid on the substrate, and calculating film thicknesses for the classified positions.

According to a twelfth aspect of the present invention, there is provided the film forming apparatus defined in the tenth aspect, wherein the simulation steps include:

a setting step for setting nozzles' application start position and application end position of the process liquid on a rotational radius of the substrate, and an initial value for at least one of the number of revolutions of the substrate, the rotation duration time of the substrate, the moving speed of the nozzles, the discharge flow velocity of the nozzles, and the temperature of the process liquid;

an application quantity calculation step for calculating, based on the information accepted at the information acceptance step, an application quantity of the process liquid for the unitary positions along the moving direction while at least one of the number of revolutions of the substrate, the rotation duration time of the substrate, the moving speed of the nozzles, the discharge flow velocity of the nozzles, and the temperature of the process liquid is varied gradually in each of the classified unitary positions along the moving direction, along one of a plurality of predetermined curves over a range of from the application start position to the application end position;

a moving quantity calculation step for calculating a moving quantity of the process liquid of the application quantity calculated at the application quantity calculation step, the moving quantity including a quantity of the process liquid that flows in to one of the unitary positions along the moving direction by the rotation of the substrate as well as a quantity of the process liquid that flows out from the one of the unitary positions;

a film thickness calculation step for calculating a film thickness for each of the unitary positions from the application quantity of the process liquid calculated at the application quantity calculation step and the moving quantity of the process liquid calculated at the moving quantity calculation step; and an iteration step for changing the curve and iterating the application quantity calculation step, the moving quantity calculation step, and the film thickness calculation step, to a number of times corresponding to a number of curves.

In the tenth, eleventh, and twelfth aspects, in the simulation process, the behavior of the process liquid on the substrate is simulated by varying at least one of the number of revolutions of the substrate, the rotation duration time of the substrate, the moving speed of the nozzles, the discharge flow velocity of the nozzles, and the temperature of the process liquid, and the film thicknesses at classified unitary positions are calculated. Therefore, without executing actual application, control conditions for obtaining an optimum film thickness can be determined in short time by simulation results.

According to a thirteenth aspect of the present invention, there is provided a film forming apparatus for forming a film of a film thickness on a substrate by discharging a process liquid toward the rotating substrate, the film forming apparatus comprising:

substrate holding means for holding the substrate rotatable;

a discharge head having nozzles for discharging the process liquid toward the substrate held by the substrate holding means;

process liquid feeding means for feeding the process liquid to the discharge head;

head moving means for moving the discharge head along a moving direction of the discharge head with respect to the substrate;

simulation means for simulating behavior of the process liquid; and control means for controlling at least any one of the substrate holding means, the nozzle moving means, and the process liquid feeding means by control conditions obtained by simulation executed by the simulation means.

According to a fourteenth aspect of the present invention, there is provided the film forming apparatus as defined in the thirteenth aspect, further comprises control condition determining means for determining the control conditions by the simulation executed by the simulation means.

According to a fifteenth aspect of the present invention, there is provided the film forming apparatus as defined in the fourteenth aspect, wherein the control condition determining means comprises:

information accepting means for accepting two kinds of information on the film thickness and viscosity of the process liquid;

simulation means for, based on the two kinds of information accepted by the information accepting means, gradually varying at least one of a number of revolutions of the substrate, a rotation duration time of the substrate, a moving speed of the nozzles, a discharge flow velocity of the nozzles, and a temperature of the process liquid in each of classified unitary positions along the moving direction, simulating behavior of the process liquid on the substrate, and calculating a film thickness for each of the classified unitary positions; and control condition acquisition means for, responsive to a film thickness calculation result by the simulation means, acquiring the control condition that at least any one of the number of revolutions of the substrate, the rotation duration time of the substrate, the moving speed of the nozzles, the discharge flow velocity of the nozzles, and the temperature of the process liquid is varied.

According to a sixteenth aspect of the present invention, there is provided the film forming apparatus as defined in the fifteenth aspect, wherein the information accepting means further accepts two kinds of information on nozzle discharge time and application area of the process liquid in addition to the two kinds of information on the film thickness and the viscosity of the process liquid; and the simulation means, based on the four kinds of information accepted by the information accepting means, gradually varies at least any one of the number of revolutions of the substrate, the rotation duration time of the substrate, the moving speed of the nozzles, the discharge flow velocity of the nozzles, and the temperature of the process liquid in each of classified unitary positions along the moving direction, simulates the behavior of the process liquid on the substrate, and calculates a film thickness for each of the classified positions.

According to a seventeenth aspect of the present invention, there is provided the film forming apparatus as defined in the fifteenth aspect, wherein the simulation means comprises:

setting accepting means for accepting settings of nozzles' application start position and application end position of the process liquid on a rotational radius of the substrate, and an initial value for at least one of the number of revolutions of the substrate, the rotation duration time of the substrate, the moving speed of the nozzles, the discharge flow velocity of the nozzles, and the temperature of the process liquid;

application quantity calculating means for calculating, based on the information accepted by the information accepting means, an application quantity of the process liquid for each of the unitary positions while at least one of the number of revolutions of the substrate, the rotation duration time of the substrate, the moving speed of the nozzles, the discharge flow velocity of the nozzles, and the temperature of the process liquid is varied gradually in each of the classified unitary positions along the moving direction, along one of a plurality of predetermined curves over a range of from the application start position to the application end position;

moving quantity calculating means for calculating a moving quantity of the process liquid of the application quantity calculated by the application quantity calculating means, the moving quantity including a quantity of the process liquid that flows in to one of the unitary positions by the rotation of the substrate as well as a quantity of the process liquid that flows out from the one of the unitary positions;

film thickness calculating means for calculating a film thickness for each of the unitary positions from the application quantity of the process liquid calculated by the application quantity calculating means and the moving quantity of the process liquid calculated by the moving quantity calculating means; and iteration means for changing the curve and iterating the operations by the application quantity calculating means, the moving quantity calculating means, and the film thickness calculating means, to a number of times corresponding to a number of curves. The nozzles are nozzles of an ink jet system.

According to an eighteenth aspect of the present invention, there is provided the film forming apparatus as defined in the thirteenth aspect, wherein the plurality of nozzles of the discharge head are arrayed in one direction at specified intervals.

According to a nineteenth aspect of the present invention, there is provided the film forming apparatus as defined in the thirteenth aspect, wherein the nozzles are nozzles of an ink jet system.

In the thirteenth to nineteenth aspects, a desired film can be formed by controlling at least any one of the three means under optimum control conditions obtained by the simulation.

According to the method for determining film thickness control conditions of the present invention, the behavior of the process liquid on the substrate is simulated by varying at least one of the number of revolutions of the substrate, the rotation duration time of the substrate, the moving speed of the nozzles, the discharge flow velocity of the nozzles, and the temperature of the process liquid, by which film thicknesses at classified unitary positions are calculated. Therefore, without executing actual application, control conditions for obtaining an optimum film thickness can be determined in short time by the results of the simulation.

BRIEF DESCRIPTION OF THE DRAWINGS

These and other objects and features of the present invention will become clear from the following description taken in conjunction with the preferred embodiments thereof with reference to the accompanying drawings, in which:

FIG. 9 is a flow chart showing the procedure for determining the control conditions by the computing unit;

DETAILED DESCRIPTION OF THE PREFERRED EMBODIMENTS

Figure 1:
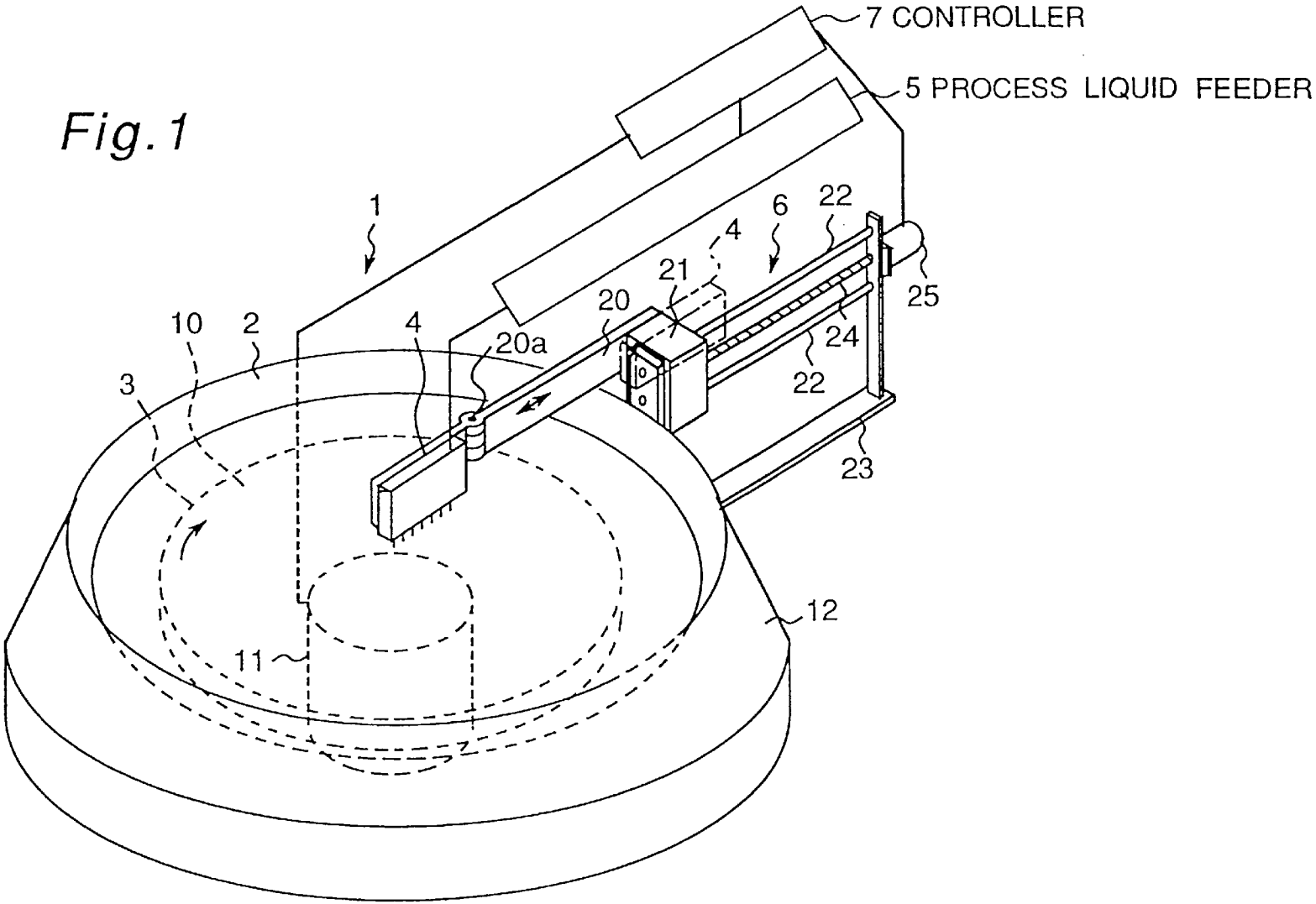
FIG. 1 is a perspective view of a film forming apparatus according to a first embodiment of the present invention.

Before the description of the present invention proceeds, it is to be noted that like parts are designated by like reference numerals throughout the accompanying drawings.

First Embodiment

FIG. 1 is a perspective view showing a film forming apparatus according to a first embodiment of the present invention.

Referring to FIG. 1, the film forming apparatus 1 comprises: a substrate holder 3, as one example of a substrate holding means, for sucking up and rotatably holding an optical disk substrate (hereinafter, referred to as "substrate") 2; a discharge head 4, as one example of a process liquid discharging means, for discharging a process liquid toward the substrate 2 held by the substrate holder 3; a process liquid feeder 5, as one example of process liquid feeding means, for feeding the process liquid to the discharge head 4; a head mover 6 for moving the discharge head 4 along its moving direction to the substrate 2, for example, radially of the substrate 2, and more specifically, radially from the central to the peripheral side of the substrate 2; and a controller 7, as one example of a liquid quantity control means, for controlling the substrate holder 3, the process liquid feeder 5, the head mover 6, and a heater 70 that controls the temperature of the process liquid within the discharge head 4.

The substrate holder 3 has a substrate holding plate 10 which is rotatable and which sucks up the substrate 2, and a substrate rotating motor 11 for rotating the substrate holding plate 10. Around the substrate holder 3, is disposed a cup 12 which surrounds the held substrate 2.

Figure 2A:
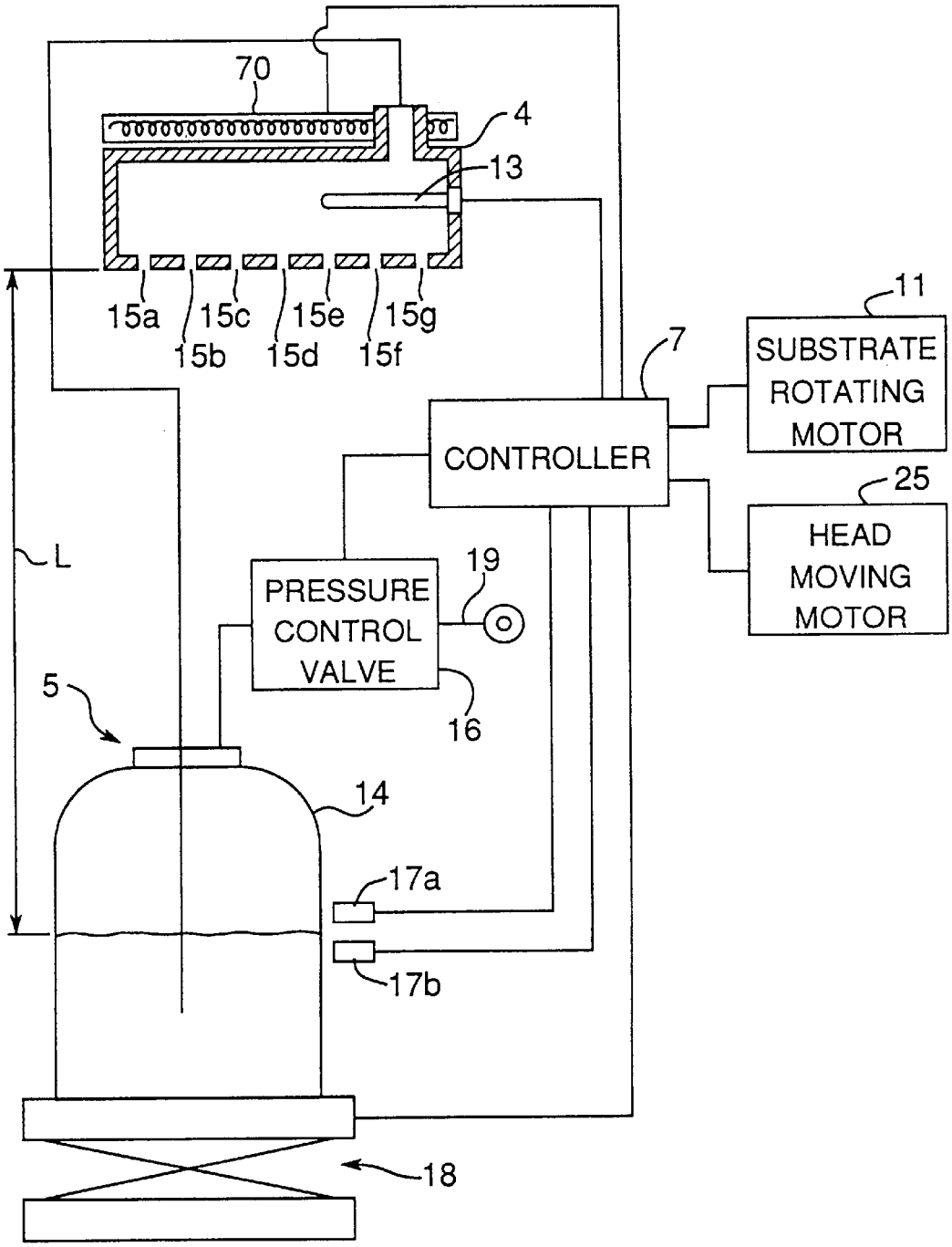
FIG. 2A is a block diagram including the process liquid feeder of the film forming apparatus.
Figure 2B:
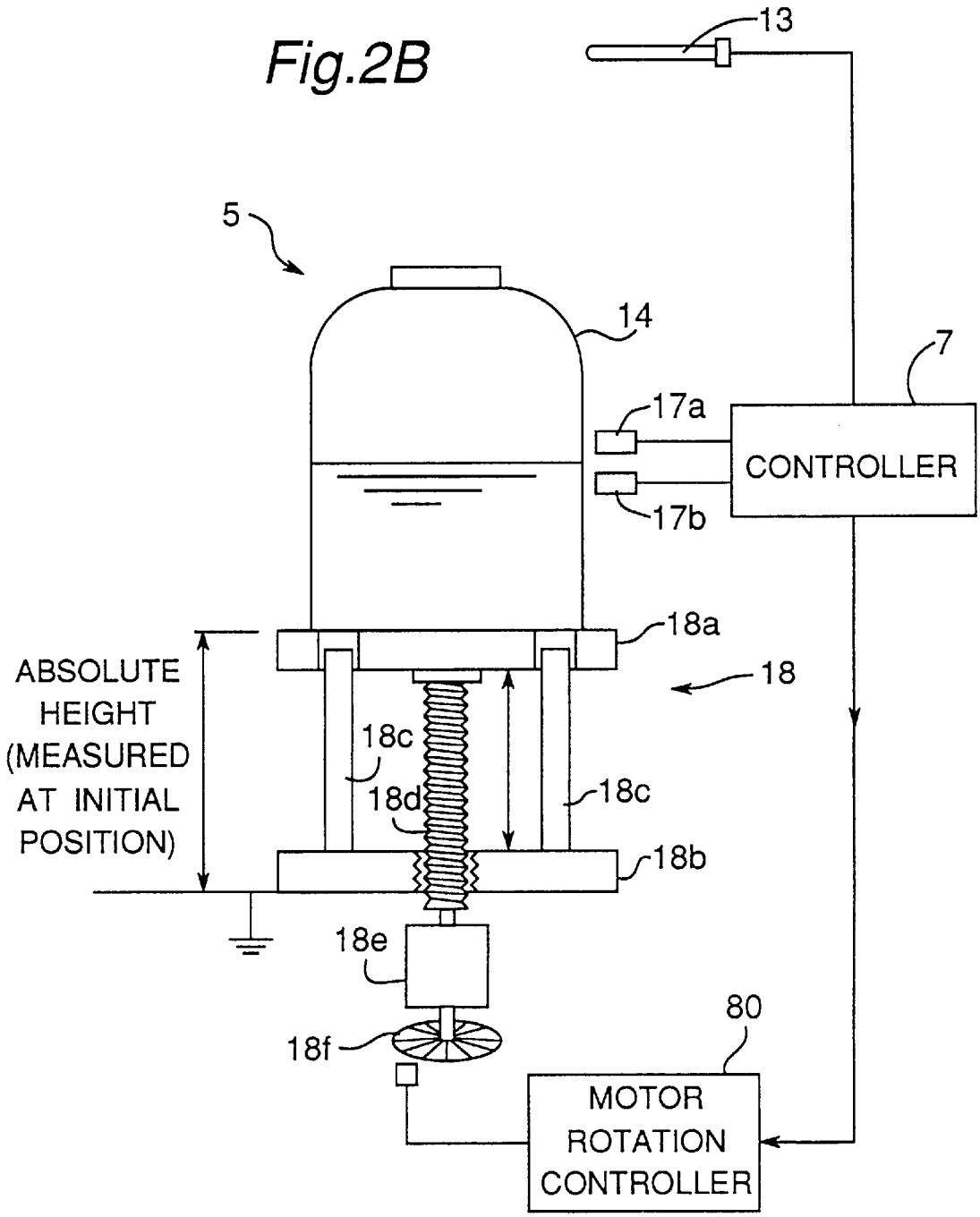
FIG. 2B is a schematic explanatory view showing the lifter of the film forming apparatus.

The discharge head 4 has nozzles 15*a*, 15*b*, 15*c*, 15*d*, 15*e*, 15*f*, 15*g* of the ink jet system, for example seven in number, with the diameter gradually increasing, as shown in FIG. 2A. The hole diameters of these nozzles 15*a* to 15*g* are determined according to the application area that increases toward the peripheral side of the substrate 2. The nozzles 15*a* to 15*g* are arrayed in line in one direction. The nozzles 15*a* to 15*g* may be arrayed either in the radial direction of the substrate 2, or in a direction crossing the radial direction at a specified angle. Since the application area is larger on the peripheral side than on the central side of the substrate 2, the minimum-diameter nozzle 15*a* is disposed on the central side of the substrate 2, while the maximum-diameter nozzle 15*g* is disposed on the peripheral side. Within the discharge head 4, is attached a temperature detector 13, as one example of a state detecting means, comprising, for example, a thermocouple for detecting the temperature of the process liquid within the discharge head 4. The heater 70 is disposed above the discharge head 4 so that the process liquid within the discharge head 4 can be heated by the heater 70 under the control of the controller 7. This heater 70 may also be disposed beside, below, or within the discharge head 4, other than above it.

The process liquid feeder 5 has a closed tank 14 for storing the process liquid. Clean pressurizing air is supplied from an unshown air source, via a pressurizing air feed pipe 19, to the closed tank 14. A pressure control valve 16 with a pressure gauge is disposed halfway along the pressurizing air feed pipe 19. Further, an upper-and-lower pair of liquid level sensors 17*a* and 17*b*, as another examples of the state detecting means for detecting the liquid level height, are disposed opposite to a side wall of the closed tank 14. The liquid level sensors 17*a* and 17*b*, which are, for example, diffusion-reflection type photosensors, are used to maintain the liquid level height from the floor surface (reference position) of the closed tank 14 between the two sensors 17*a* and 17*b*. When the process liquid is present in the closed tank 14 to be opposite to the sensors 17*a*, 17*b*, the sensors are on, and when the process liquid is not present, the sensors are off. Out of these two sensors 17*a*, 17*b*, when the upper sensor 17*a* is off and the lower sensor 17*b* is on, the liquid level is at a proper position between the two sensors 17*a*, 17*b*. When both of the two sensors 17*a*, 17*b* are off, the liquid level is too low. When both of the sensors 17*a*, 17*b* are on, the liquid level is too high. The closed tank 14 is placed on a lifter 18 that can move up and down. The lifter 18 ascends or descends responsive to detection results of the liquid level sensors 17*a*, 17*b*.

The head mover 6 moves the discharge head 4 between a start position shown by solid line and a retraction position shown by two-dot chain line in FIG. 1, in the radial direction of the substrate 2. The head mover 6 comprises an arm 20 with the discharge head 4 mounted at the end, a moving frame 21, an upper-and-lower pair of guide rails 22, a holding frame 23, a screw shaft 24, and a moving motor 25. The arm 20 has halfway a rotating portion 20*a* for adjusting the mounting position of the discharge head 4 about the vertical axis. The moving frame 21 is attached at the base end of the arm 20. The upper-and-lower pair of guide rails 22 guide the moving frame 21 horizontally. The holding frame 23 holds both ends of the guide rails 22 and rotatably supports the screw shaft 24. The screw shaft 24 is arranged between the guide rails 22 and is parallel to the guide rails 22. A rotary shaft of the moving motor 25 is connected to one end of the screw shaft 24. Guide bearings (not shown) rollably supported by the guide rails 22 are mounted within the moving frame 21.

The controller 7 comprises a microcomputer including CPU, ROM, RAM, and the like as shown in FIG. 2A. To the controller 7, are connected the heater 70 for heating the process liquid in the discharge head 4, the pressure control valve 16 of the process liquid feeder 5, the liquid level sensors 17*a*, 17*b*, a drive motor 18*e* for the lifter 18, the temperature detector 13 of the discharge head 4, the substrate rotating motor 11 of the substrate holder 3, and the moving motor 25 of the head mover 6. Further connected to the controller 7 are input keys (not shown) including the start key for operation start-up, and other input/output devices including various sensors such as the sensors for detecting the rotational position of the screw shaft 24, and the number of revolutions of the substrate rotating motor 11.

Figure 3:
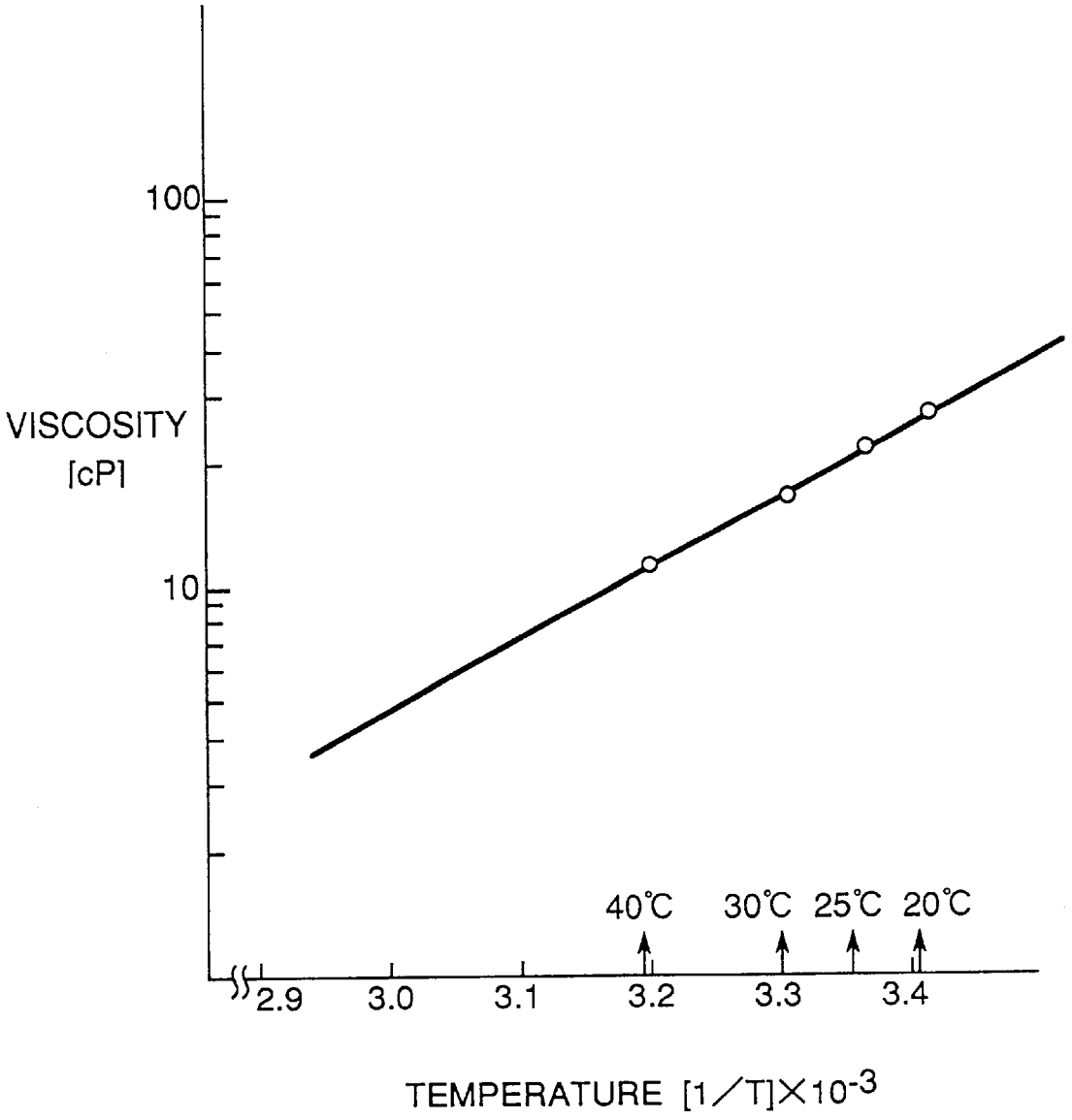
FIG. 3 is a graph showing the temperature-viscosity characteristic of the process liquid to be used in the first embodiment.

In the ROM, located within the microcomputer, is stored a temperature-pressure difference table for compensating variations in the discharge flow velocity from the nozzles 15*a*–15*g* due to variations in the viscosity of the process liquid that vary with temperature. FIG. 3 shows the relationship between temperature and viscosity of the process liquid. As shown in FIG. 3, as the temperature of the process liquid decreases, the viscosity increases proportionally. Further, the discharge flow velocity Q of the process liquid discharged from the nozzles 15*a*–15*g* varies depending on the viscosity and the pressure difference as shown in the following Equation (1):

$$Q=100(\pi d^4/128\mu)(p_1-p_2)/l \quad (1)$$

where d is the diameter (mm) of the process liquid feed pipe, $\mu$ is the viscosity of the process liquid (cP), $p_1-p_2$ is the pressure (dyne) difference between inlet and outlet of the process liquid feed pipe, and l is the length (mm) of the process liquid feed pipe.

Therefore, the relationship between pressure difference and viscosity, for maintaining constant the discharge flow velocity Q according to Equation (1) is stored in the ROM with the viscosity converted into temperature. For example, since the viscosity will decrease by about 1 cp (centipoise) with a 1° C. increase of temperature around 20° C. as shown in FIG. 3, the controller 7 responsively reads the pressure difference corresponding to the temperature by looking up to the table, and adjusts the liquid level by lifting or lowering the liquid level to an extent corresponding to the pressure difference.

When the process liquid is discharged towards the substrate 2, the liquid level within the closed tank 14 lowers gradually. Then, the height difference L between the liquid level and the discharge head 4 gradually increases, such that the head (water head) between them gradually increases, while the pressure of the process liquid gradually decreases and then the discharge flow velocity decreases. To prevent this, it is necessary to maintain the height difference L constant. Therefore, the closed tank 14 is gradually lifted by the lifter 18 in response to the discharge of the process liquid so that the liquid level is normally held between the liquid level sensors 17*a*, 17*b*.

The lifter 18 is movable up and down by means of such a mechanism as shown in FIG. 22. More specifically, the lifter 18 comprises: upper-and-lower support plates 18*a*, 18*b*; guide rods 18*c*; a screw shaft 18*d* which has its upper end rotatably fixed to the upper support plate 18*a* and which is screwed to the lower support plate 18*b*; the motor 18*e* for rotating the screw shaft 18*d* connected to its rotary shaft; a rotary encoder 18*f* for detecting the number of revolutions of the motor 18*e*; and a rotation controller 80 for controlling the rotation of the motor 18*e* under the control of the controller 7 based on the number of revolutions of the motor 18*e* detected by the rotary encoder 18*f*. Therefore, under the control of the controller 7, via the motor rotation controller 80, the screw shaft 18*d* of the motor 18*e* is rotated so that the upper support plate 18*a* is moved up and down with respect to the lower support plate 18*b*, by which the closed tank 14 fixed on the upper support plate 18*a* is moved up and down. Actually, the absolute height between the upper support plate 18*a* and the lower support plate 18*b* with the closed tank 14 in the initial position is previously measured, and the closed tank 14 is moved up and down under the control of the controller 7 with respect to this absolute height.

Figure 4:
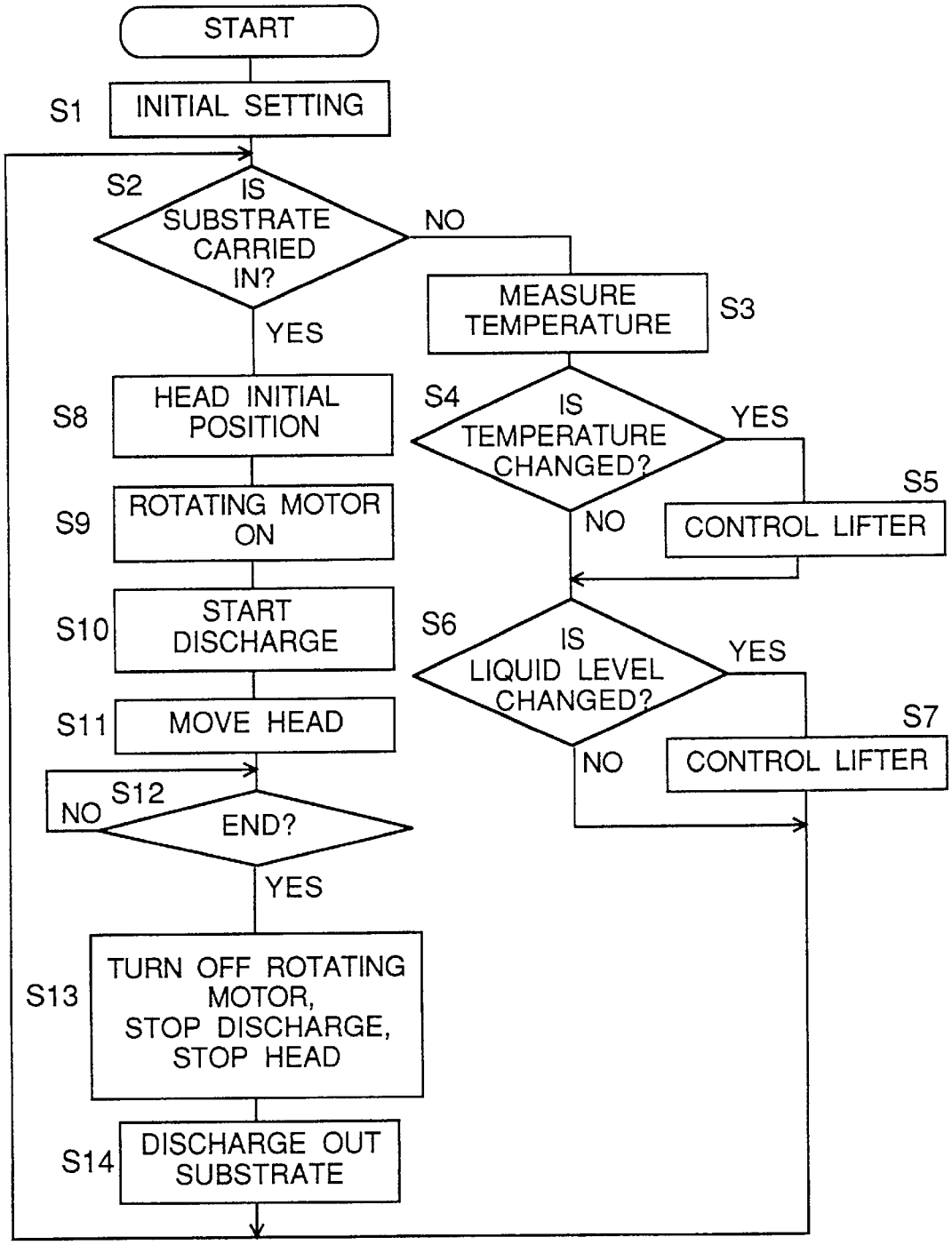
FIG. 4 is a control flow chart showing the operation of the film forming apparatus.

Next the operation of this first embodiment is explained according to the control flow chart as shown in FIG. 4.

At step S1 of FIG. 4, the initial setting is executed. In this initial setting, the head mover 6 locates the discharge head to the retraction position as shown by the two-dot chain lines. Also, the temperature-pressure difference table stored in the ROM is written into the RAM. At step S2, it is decided whether or not the substrate 2 has been fitted to the substrate holding plate 10. Unless the substrate 2 is fitted, the program goes to step S3.

At step S3, a measurement result of the temperature detector 13 is read. At step S4, it is decided whether or not a measured temperature change is not less than a specified value. If the temperature change is less than the specified value, the program goes to step S6. If the temperature change is not less than the specified value, then the program goes to step S5, where the pressure difference corresponding to the temperature change is read from the temperature-pressure difference table, and the lifter 18 is moved up or down to an extent corresponding to the pressure difference, by which any pressure fluctuation is suppressed. Then, the program goes to step S6. In this embodiment, since the pressure is adjusted by lifting or lowering the liquid level with the lifter 18 moved up or down, the pressure can be adjusted in very small steps on the order of around 1 mmAq. At step S6, it is decided whether or not the liquid level is between the liquid level sensors 17*a*, 17*b*. When both of the two sensors 17*a*, 17*b* have turned off with the liquid level lowered, the program goes to step S7, where the lifter 18 is moved up until the sensor 17*b* is turned on, so that the liquid level of the closed tank 14 reaches a point in between the upper sensors 17*a*, 17*b*. If it is decided at step S6 that no change in the liquid level has occurred, or if the lifter control process at step S7 is ended, then the program returns to step S2.

When the substrate 2 is fitted to the substrate holding plate 10, the program moves from step S2 to step S8. At step S8, the discharge head 4 is located at the start position indicated by the solid lines in FIG. 1 by the head mover 6. At step S9, the substrate rotating motor 11 is turned on. At step S10, pressurizing gas is fed to the closed tank 14, so that the process liquid is discharged from the discharge head 4 to the substrate 2. Then, at step S11, the discharge head 4 is moved gradually toward the peripheral side of the substrate 2. At step S12, it is awaited that the discharge head 4 reaches the application end position. When the discharge head 4 has reached the application end position, the program goes to step S13. At step S13, the rotating motor 11, the moving motor 25, and the discharge of the process liquid are off. At step S14, a substrate discharge-out command is transmitted to a substrate transfer unit, the program returning to step S2.

In this embodiment, since the feed amount of process liquid is changed depending on temperature variations of the process liquid, the process liquid can easily be dispensed at a constant quantity irrespective of any changes in the state of the process liquid. Also, since any variations in the liquid level due to consumption of the process liquid are controlled so that the liquid level from the reference plane is maintained within a specified range, the process liquid feed pressure is unlikely to change so that the process liquid can be dispensed at a constant quantity more easily.

In the first embodiment, in a case where the discharge amount is controlled by the controller 7, the process liquid can be heated by the heater 70 when the temperature of the process liquid in the head 4 is too low.

Other modification examples of the first embodiment are described below.

(a) Instead of the arrangement such that the feed pressure is adjusted by moving the lifter 18 up or down, the feed pressure of the process liquid may also be adjusted by controlling the pressure of the pressurizing gas with the pressure control valve 16 controlled.

Figure 5:
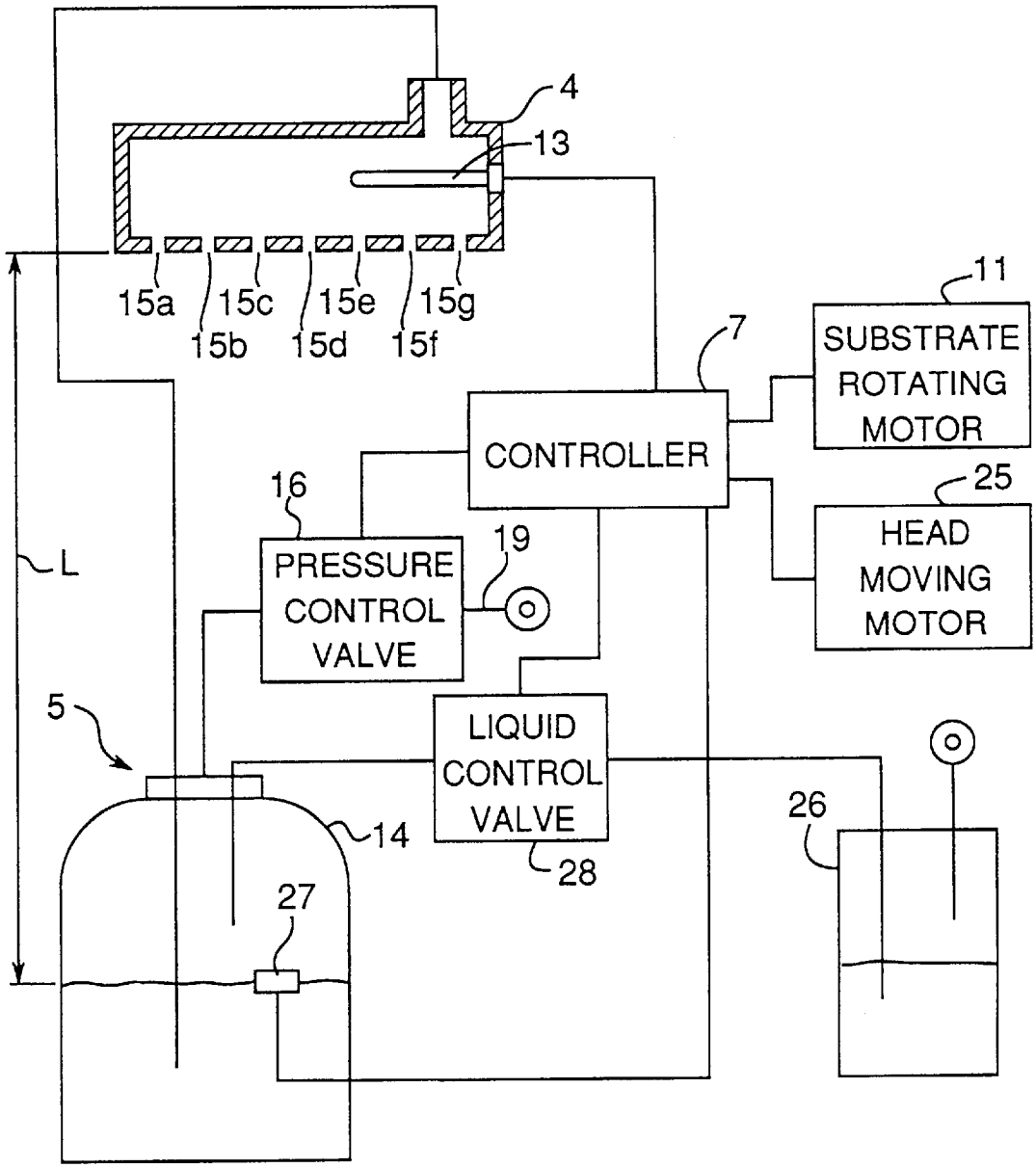
FIG. 5 is a block diagram, corresponding to FIG. 2, of a modification of the first embodiment of the invention.

(b) As shown in FIG. 5, without providing the lifter 18, there may be provided a replenishment tank 26 for replenishing the process liquid to the closed tank 14, a liquid level sensor 27 for detecting the liquid level from the bottom surface of the closed tank 14, and a liquid control valve 28 for controlling a replenishing operation from the replenishment tank 26, by which the process liquid is replenished responsive to decreases in the liquid level so that the feed pressure is adjusted.

Figure 6:
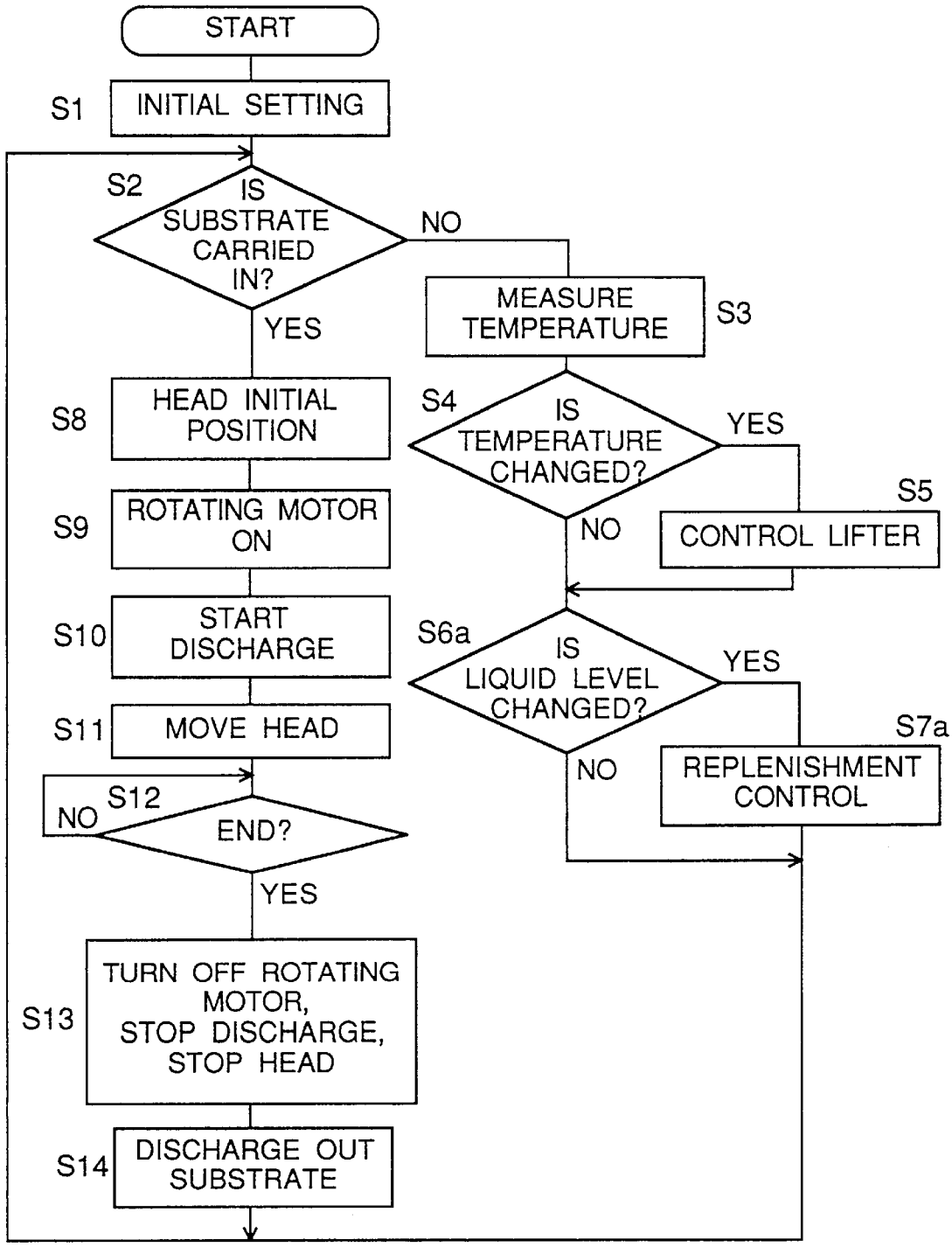
FIG. 6 is a flow chart, corresponding to FIG. 4, of the modification of FIG. 5.

In this case, if it is detected by the liquid level sensor 27 that the liquid level has lowered below a specified height at step S6 in FIG. 6, then the program goes to step S7*a*, where the liquid control valve 28 may be controlled instead of the lifter control so that a specified quantity of process liquid is replenished from the replenishment tank 26.

Figure 7:
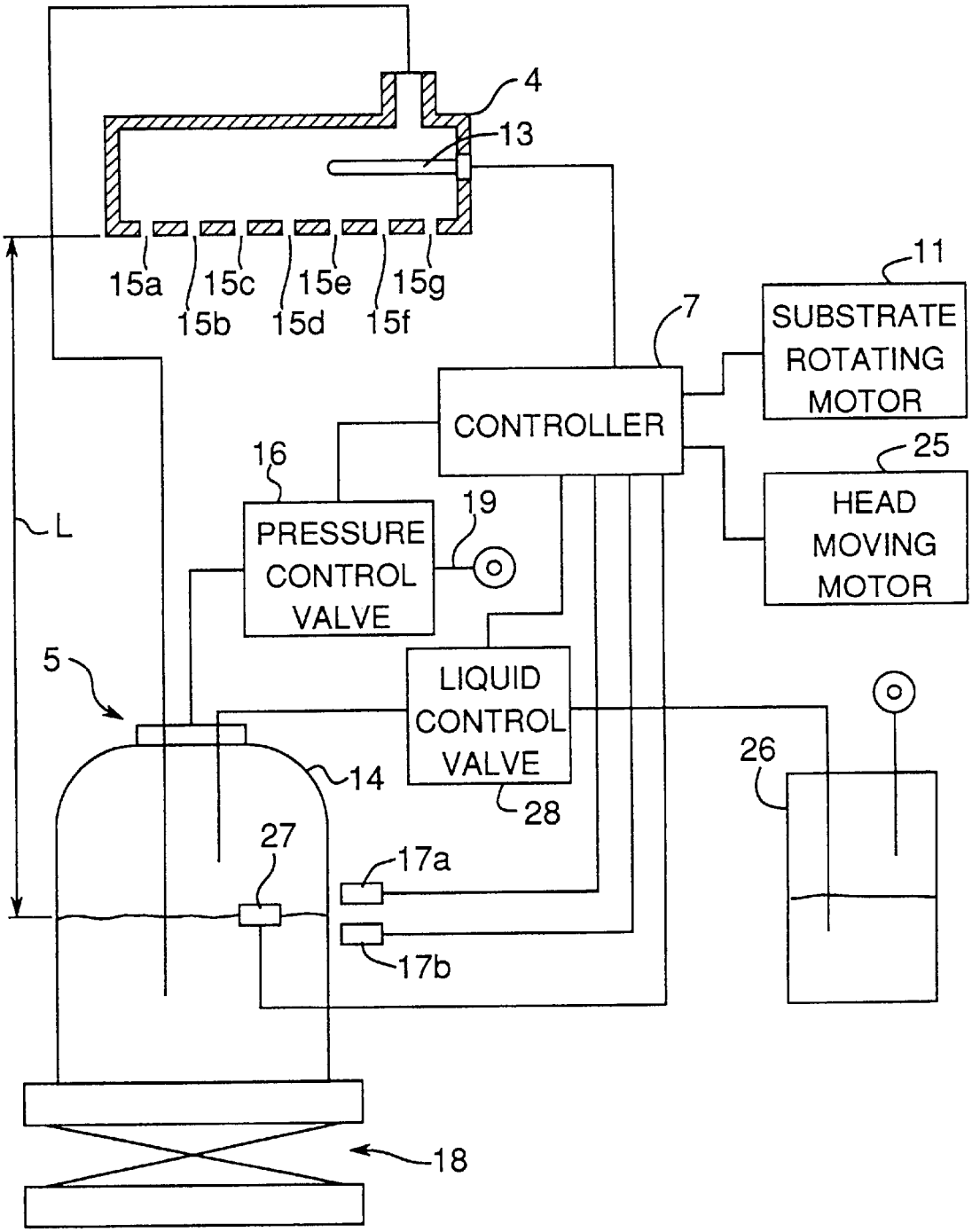
FIG. 7 is a block diagram, corresponding to FIG. 2, of another modification of the first embodiment of the invention.

(c) As shown in FIG. 7, it may also be arranged that the lifter 18, the replenishment tank 26, the liquid level sensor 27, and the liquid control valve 28 are provided, where the liquid level control is executed by the lifter 18 for normal cases, and when the process liquid within the closed tank 14 has decreased to a small amount, the process liquid is replenished from the replenishment tank 26 and the lifter 18 is located at the lowered position.

(d) The process liquid feeder 5 may also be implemented by a constant-quantity discharge pump that is capable of changing the discharge flow velocity, or the like.

(e) The discharge head does not need to be moved when the substrate is of a very small area.

(f) Whereas the substrate 2 is rotated in the foregoing embodiment, the present invention may also be applied to arrangements in which the substrate 2 is not rotated.

As described above, according to the present invention, since the process liquid feed quantity is controlled responsive to the state of the process liquid, such as temperature and liquid level, the process liquid can be discharged at the most constant possible rate irrespective of changes in the state of the process liquid.

Second Embodiment

Figure 8A:
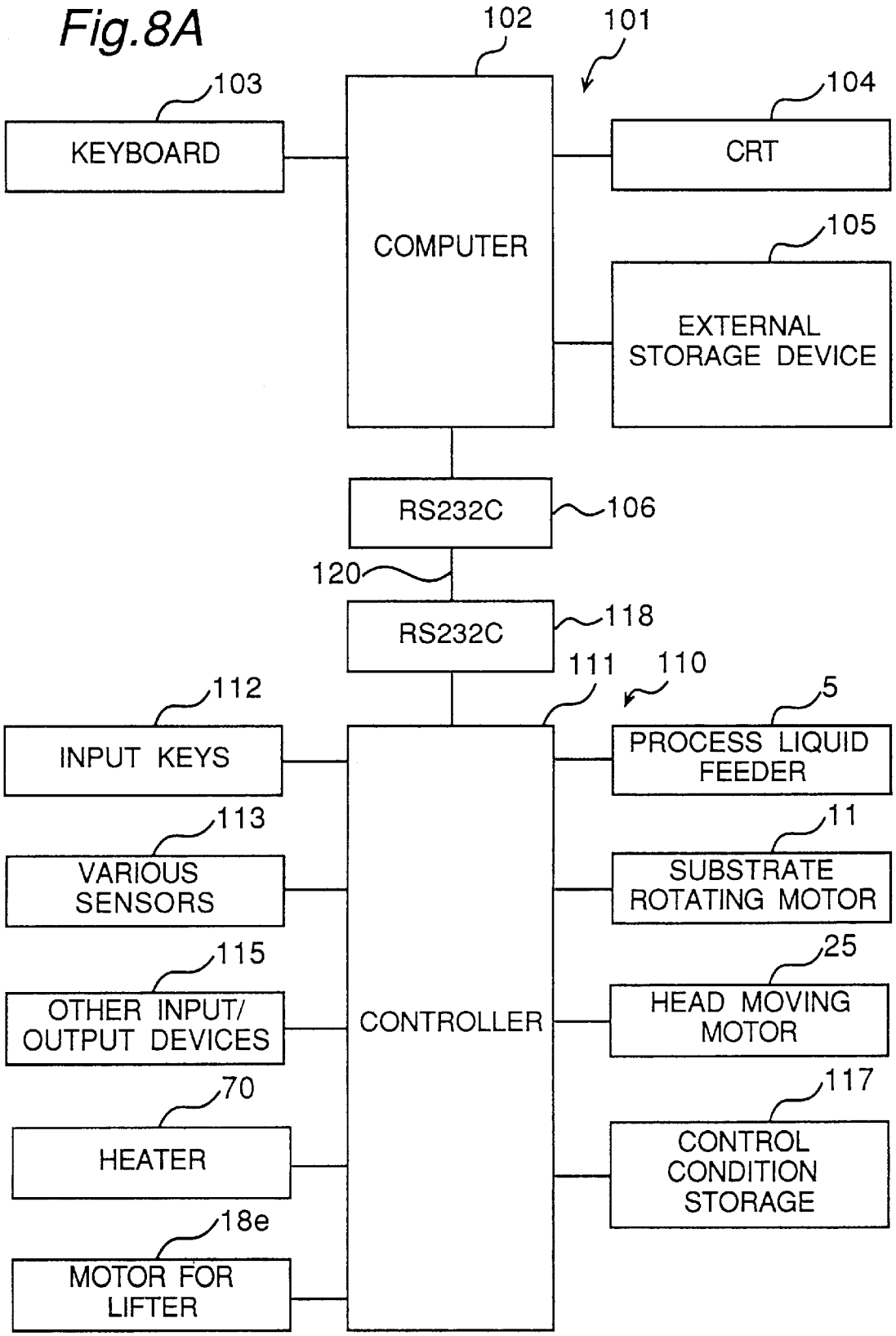
FIG. 8A is a block diagram of the computing unit to be used for carrying out the control condition determining method according to a second embodiment of the invention, as well as the control unit of the film forming apparatus.

FIG. 8A is a block diagram showing the arrangements of the computing unit 101 to be used for carrying out a second embodiment of the method for determining control conditions according to the present invention, as well as the control unit for controlling the film forming apparatus 1 under the determined control conditions.

Figure 15:
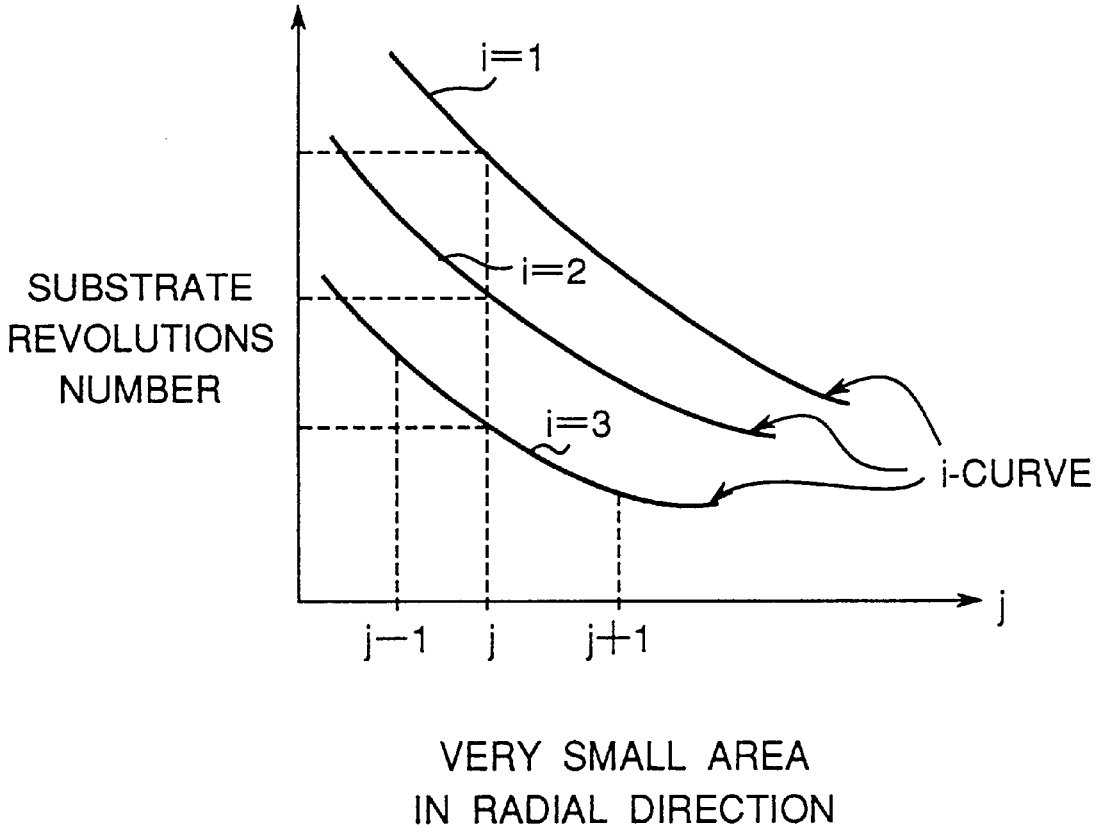
FIG. 15 is a diagram showing a relationship between the number of revolutions of the substrate, and the i-curve and the very small area j.

The computing unit 101 that determines the control conditions is a so-called personal computer, having a computer 102 equipped with a CPU board and various types of I/O boards. To the computer 102, are connected a keyboard 103, a CRT display 104, and an external storage device 105 such as a HD (Hard Disk) drive, FD (Floppy Disk) drive, or CD-ROM drive. Also connected to the computer 102 is an RS-232-C interface board 106, which is a serial interface. The computer 102 calculates film thicknesses for very small individual areas at radial positions of the substrate, in the case where the process liquid is applied under various conditions, through the process of simulating the behavior of the process liquid, and determines control conditions from the calculated film thicknesses. In the external storage device 105, a plurality of kinds of curves for reducing the number of revolutions of the substrate, the rotational speed, the temperature (viscosity) of the process liquid or the head moving speed used for the simulation in each of the very small areas classified in the radial direction of the substrate are stored in the form of a table. Preferably, these curves are, for example, approximations to curves that are inversely proportional to the square of the radius. As one example, FIG. 15 shows a relationship between the revolution number of the substrate, and i-curve and very small area j.

The control unit 110 of the film forming apparatus 1 is arranged instead of the controller 7 in the first embodiment, and has a controller 111 comprising a microcomputer having CPU, RAM, ROM, and the like. To the controller 111, connected are input keys 112 for entering commands or numerical values, various sensors 113, as one example of the status detecting means for detecting the state of the process liquid, such as the liquid level sensors 17*a*, 17*b*, 27 and the temperature detector 13, a process liquid feeder 5 for feeding the process liquid to the discharge head 4 that discharges the process liquid, a substrate rotating motor 11 for rotating the substrate 2, a head moving motor 25 for moving the discharge head 4, a control condition storage 117 for storing the control conditions determined by the computing unit 101, and other input/output devices 115. Further connected to the controller 111 is an RS-232-C interface board 118 for communication with the computing unit 101. The two RS-232-C interface boards 106 and 118 are connected to each other by a connection line 120.

The film forming apparatus 1 to which the second embodiment is applied is the same apparatus as described in the first embodiment, and its process liquid feeder 5 comprises, for example, a constant-quantity discharge pump capable of adjusting the discharge flow velocity, a pressurized closed tank, and the like so that the process liquid feeder 5 feeds the process liquid to the discharge head 4 at a constant discharge flow velocity determined depending on the application area, processing time, and film thickness.

Next the procedure for determining the film thickness control conditions of the computer 102 is explained below.

Figure 10:
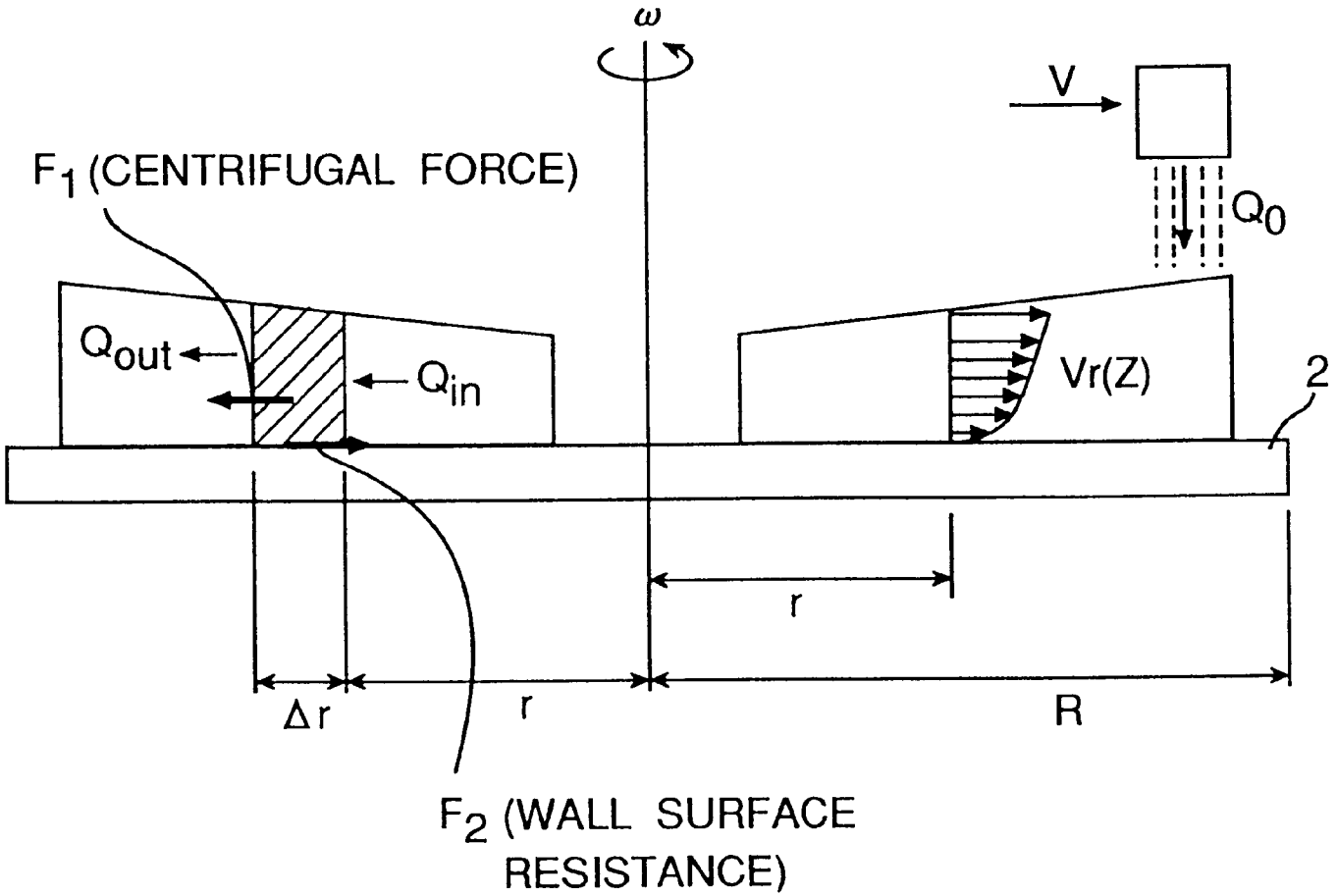
FIG. 10 is a view for explaining a simulation analysis model.

In the simulation by the computer 102, as shown in FIG. 10, the radial positions between the start position and the end position of application of the process liquid on the substrate 2 are classified into very small areas Δr, and the quantities of the process liquid that centrifugally move with respect to the very small areas Δr, i.e., an inflow quantity $Q_{in}$ of the process liquid that flows into a very small area Δr with the centrifugal force as well as an outflow quantity $Q_{out}$ of the process liquid that flows out from the very small area Δr with the centrifugal force are determined, and further a quantity $Q_0$ of the process liquid that is applied to the very small area Δr is added to the calculation result. The result of these calculations is divided by a ring-shaped cross sectional area $S_r$ of the very small area Δr, by which a film thickness $h_r$ of the very small area Δr is calculated. That is, the film thickness is calculated by the following Equation (2):

$$h_r=(Q_{in}-Q_{out}+Q_0)/S_r \quad (2)$$

Figure 11:
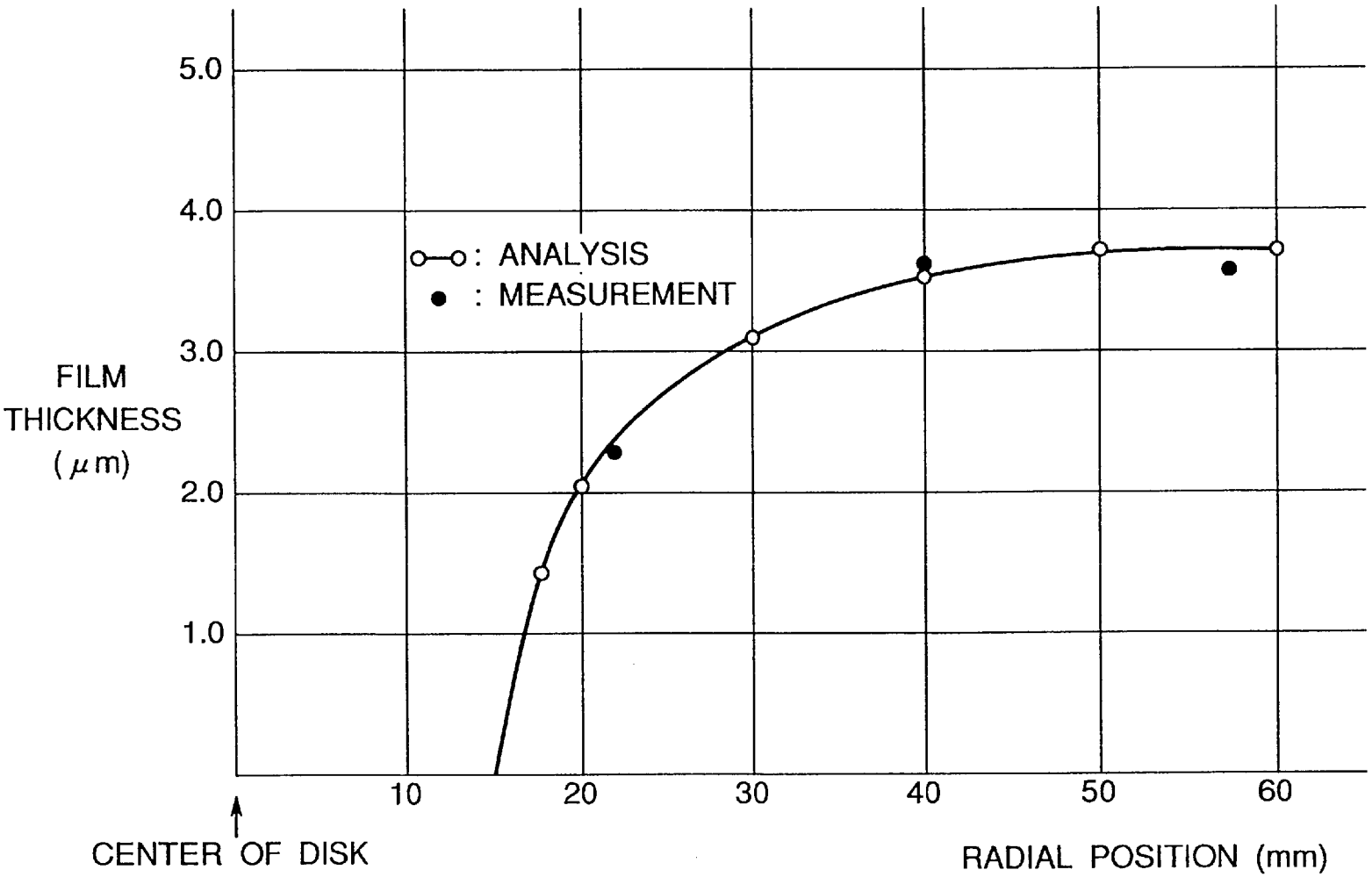
FIG. 11 is a graph showing film thicknesses calculated by simulation as well as actually measured values.

Film thickness calculated values by this simulation as well as measured values are shown in FIG. 11. As shown in FIG. 11, the film thickness calculated values indicated by circles and the film thickness measured values indicated by new moon circles are extremely approximate to each other, proving that the foregoing simulation is significantly effective.

More specifically, at step P1 of FIG. 9, the initial setting is executed. At step P2, input of simulation conditions such as an application area of the substrate, which is the object of the simulation, as well as a desired film thickness, an application time, in other words, a time for discharging the process liquid from the nozzles, and a viscosity of the process liquid, is accepted. At this time, input of a temperature of the process liquid is accepted and then, the viscosity may be calculated from the table of temperature-viscosity relationship. At step P3, a variable "i" showing the number simulation is set to 1. At step P4, the "i"th curve is read out of the curves stored in the external storage device 105. At step P5, input of initial values of the start position and the end position of application on the substrate as well as the substrate rotating speed and the head moving speed is accepted. At step P6, a variable "j" showing the position of the very small area is set to 1. At step P7, the "j" number of revolutions of the substrate, the "j" rotational speed of the substrate, the "j" moving speed of the nozzles, and the "j" temperature (viscosity) of the process liquid at the very small area "j" of the "i"th curve read at step P4 are read out. At step P8, the process liquid application quantity $Q_0$ from the discharge head 4 at the "j"th very small area is calculated from the read "j" moving speed and the process liquid discharge flow velocity. It is noted that the discharge flow velocity is calculated from the application area, film thickness, nozzle discharge time, and process liquid viscosity entered at step P2. At step P9, the inflow quantity $Q_{in}$ and outflow quantity $Q_{out}$ (i.e., moving quantity) with respect to the "j"th very small area are calculated from the read "j" rotational speed and application quantity $Q_0$. At step P10, the film thickness $h_r$ at the "j"th very small area is calculated by the foregoing Equation (2). At step P11, it is decided whether or not the simulation up to the application end position with one curve has been completed. If it has not been completed, the program goes to step P12, where the variable "j" is incremented and the program returns to step P7 so that the simulation for the next very small area "j+1" is executed. In the simulation, the "j" number of revolutions of the substrate, the "j" rotational speed of the substrate, the "j" moving speed of the nozzles, and the "j" temperature (viscosity) of the process liquid are automatically determined as the variable "j" showing the position of the very small area is increased, by determining respective i-curves. For example, in a process liquid which is not dried such as ultraviolet-curing resin, the viscosity of the process liquid is constant at $1 \leqq j \leqq n$, where n is a natural number of the very small areas at their end in the radial direction. In a thermosetting resin or resist liquid, the viscosity of the process liquid is varied at $1 \leqq j \leqq n$.

If it is decided that the simulation with one curve has been completed, the program moves from step P11 to step P13. At step P13, it is decided whether or not the simulation with all the curves has been completed. If it is decided that the simulation with all the curves has not been completed yet, the program goes to step P14. At step P14, the variable "i" showing the number of curves is incremented, and the program returns to step P4 so that the simulation for the next curve "i+1" is executed.

If it is decided that the simulation with all the curves has been completed, the program moves from step P13 to step P15. At step P15, the film thickness calculation results obtained for the very small areas are compared with a desired film thickness for each curve, and their deviations are determined. At step P16, the determined deviations are statistically processed so that a standard deviation and an average value for each curve are determined. At step P17, from the resulting standard deviation and average value, the way in which the speed changes in a curve whose absolute value of the average value is small and whose standard deviation is small is determined as control conditions. The determined control conditions are stored in, for example, the external storage device 105.

Figure 12:
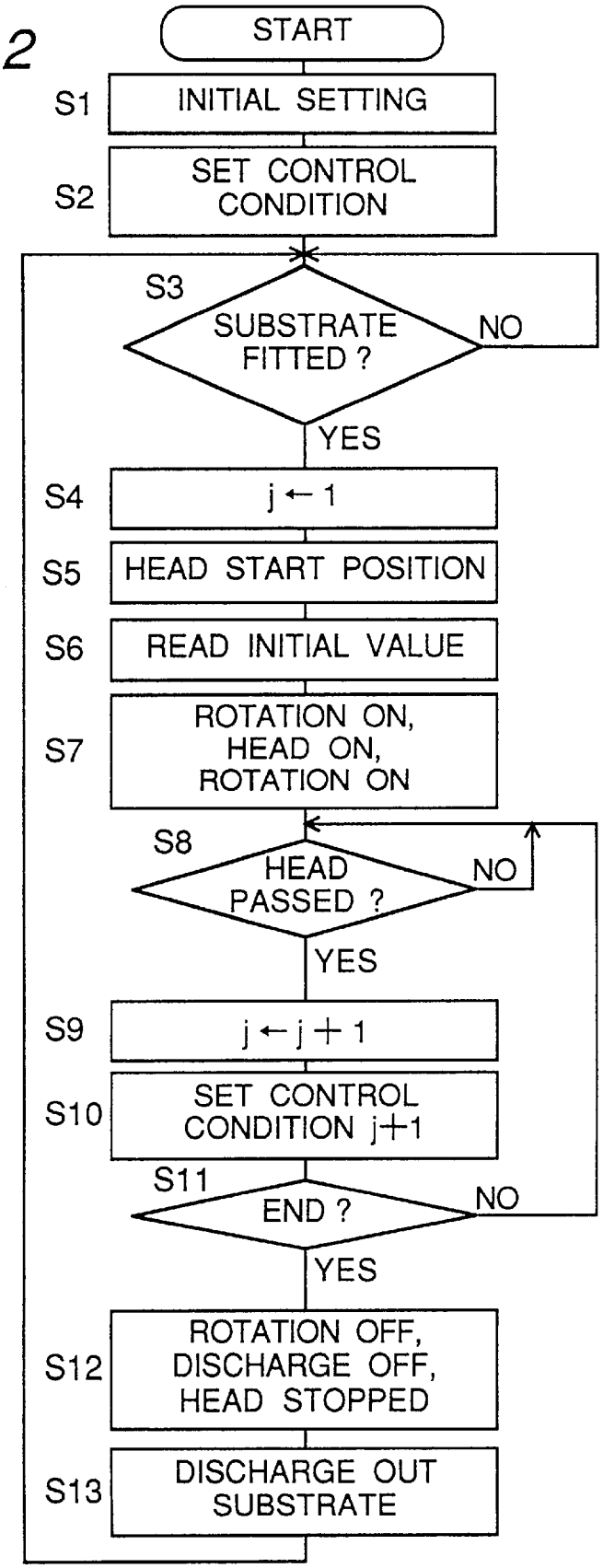
FIG. 12 is a control flow chart of the film forming apparatus.

With the control conditions obtained in this way, the film forming apparatus 1 operates according to the control flow chart as shown in FIG. 12.

First, at step S1 of FIG. 12, the initial setting is executed. In this initial setting, the discharge head 4 is located to the retraction position as shown by the two-dot chain lines in FIG. 1. At step S2, the control conditions determined by the computer 102 are read via the RS-232-C interface boards 106, 118, and stored into the control condition storage 117. At step S3, it is awaited that the substrate 2 is fitted to the substrate holding plate 10. When the substrate 2 is fitted, the program goes to step S4, where the variable "j" showing a very small area is set to 1. At step 5, the discharge head 4 is moved from the retraction position to the discharge start position. At step S6, the control conditions, i.e. initial values of control conditions, for the very small area "j" are read and set from the control condition storage 117. At step S7, the substrate rotating motor 11 and the head moving motor 25 are turned on, so that the process liquid starts being discharged from the process liquid feeder 5. The motors 11, 25 in this process are controlled with the read initial values. At step S8, it is decided whether or not the discharge head 4 has passed the very small area "j". If the discharge head 4 has passed the very small area "j", the program goes to step S9, where the variable "j" is incremented. At step S10, the head moving speed and substrate rotational speed for the new very small area "j+1" are read and set from the control condition storage 117. As a result, the head moving speed and rotational speed are reduced by specified quantities.

At step S11, whether or not the application has been completed is decided depending on whether or not the discharge head 4 has reached the application end position. If the application has not been completed, the program goes to step S8, and the operations of steps S8 to S10 are repeated. With the application completed, the program moves from step S11 to step S12, where the substrate rotating motor 11 and the head moving motor 25 are turned off, so that the feeding of the process liquid by the process liquid feeder 5 is stopped. At step S13, a substrate discharge-out command is issued to another substrate transfer unit, and then the program returns to step S3.

Figure 8B:
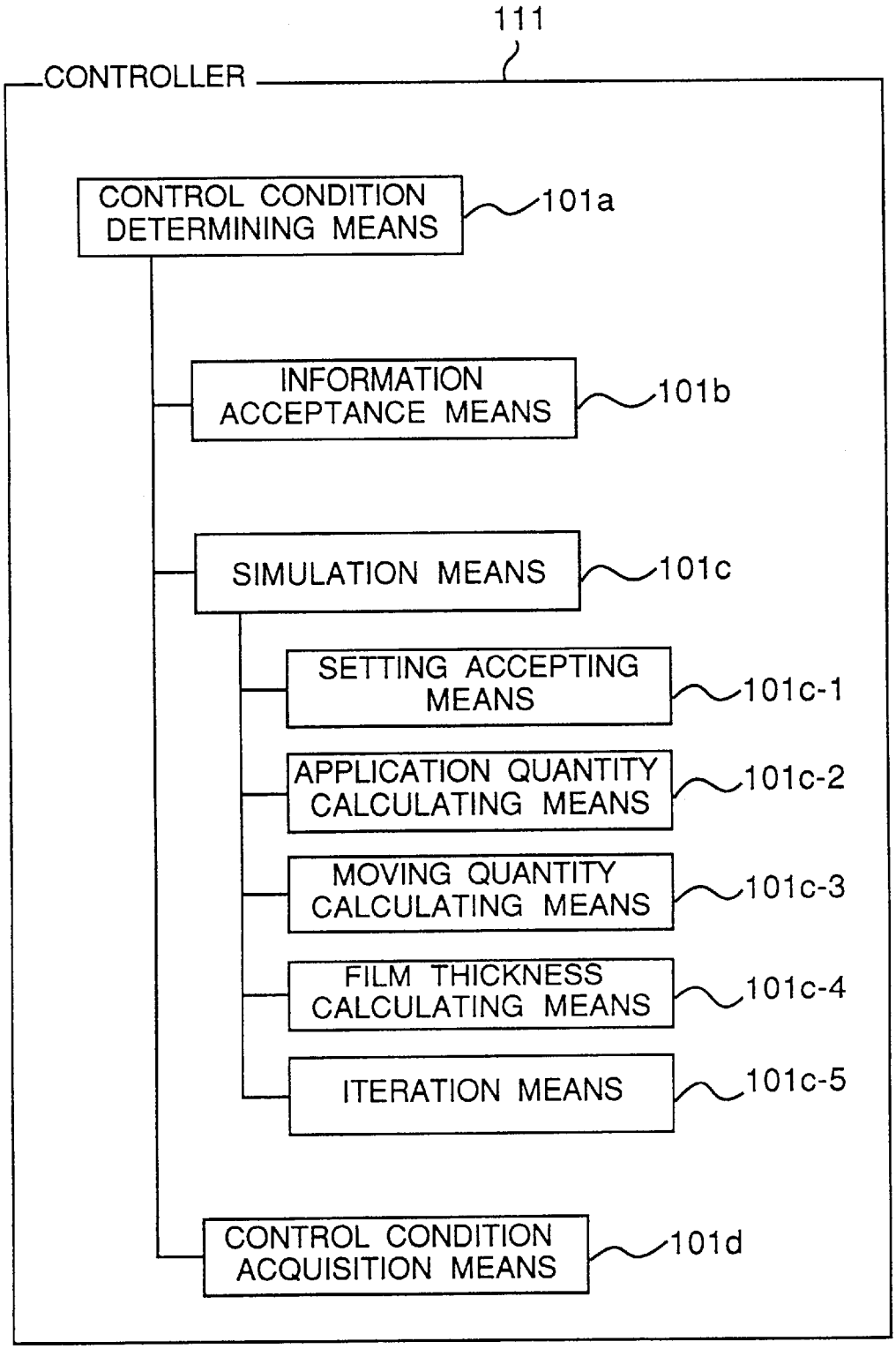
FIG. 8B is a block diagram for functionally explaining the control unit.

In order to carry out the control operation, as shown in FIG. 8B, the controller 111 of the control unit 110 comprises a control condition determining means 101*a* for determining the control conditions by the simulation. The control condition determining means 101*a* comprises an information accepting means 101*b* for accepting at least two kinds of information on the desired film thickness and viscosity of the process liquid, a simulation means 101*c* for, based on the two kinds of information accepted by the information accepting means 101*b*, gradually varying at least one of a number of revolutions of the substrate 2, a rotation duration time of the substrate 2, a moving speed of the nozzles 15*a*–15*g*, a discharge flow velocity of the nozzles 15*a*–15*g*, and a temperature of the process liquid in each of classified unitary positions along the moving direction, simulating behavior of the process liquid on the substrate 2, and calculating a film thickness for each of the classified unitary positions, and a control condition acquisition means 101*d* for, responsive to a film thickness calculation result by the simulation means 101*c*, acquiring the control condition that at least any one of the number of revolutions of the substrate 2, the rotation duration time of the substrate 2, the moving speed of the nozzles 15*a*–15*g*, the discharge flow velocity of the nozzles 15*a*–15*g*, and the temperature of the process liquid is varied. Preferably, the information accepting means 101*b* further accepts two kinds of information on the nozzle discharge time (time for discharging the process liquid from the nozzles) and application area of the process liquid in addition to the two kinds of information on the desired film thickness and the viscosity of the process liquid, and the simulation means 101*c* carries out the simulation based on the four kinds of information accepted by the information accepting means 101*b* to calculate a film thickness for each of the classified positions. The simulation means 101*c* comprises a setting accepting means 101*c*-1 for accepting settings of the nozzles' application start position and application end position of the process liquid on a rotational radius of the substrate 2, and an initial value for at least one of the number of revolutions of the substrate 2, the rotation duration time of the substrate 2, the moving speed of the nozzles 15*a*–15*g*, the discharge flow velocity of the nozzles 15*a*–15*g*, and the temperature of the process liquid, an application quantity calculating means 101*c*-2 for calculating, based on the information accepted by the information accepting means 101*b*, an application quantity of the process liquid for each of the unitary positions while at least one of the number of revolutions of the substrate 2, the rotation duration time of the substrate 2, the moving speed of the nozzles 15*a*–15*g*, the discharge flow velocity of the nozzles 15*a*–15*g*, and the temperature of the process liquid is varied gradually in each of the classified unitary positions along the moving direction, along one of a plurality of predetermined curves over a range defined by the application start position to the application end position, a moving quantity calculating means 101*c*-3 for calculating a moving quantity of the process liquid of the application quantity calculated by the application quantity calculating means 101*c*-2, the moving quantity including a quantity of the process liquid that flows in to one of the unitary positions by the rotation of the substrate 2 as well as a quantity of the process liquid that flows out from the one of the unitary positions, a film thickness calculating means 101*c*-4 for calculating a film thickness for each of the unitary positions from the application quantity of the process liquid calculated by the application quantity calculating means 101*c*-2 and the moving quantity of the process liquid calculated by the moving quantity calculating means 101*c*-3, and an iteration means 101*c*-5 for changing the curve and iterating the operations by the application quantity calculating means 101*c*-2, the moving quantity calculating means 101*c*-3, and the film thickness calculating means 101*c*-4, to a number of times corresponding to a number of curves. The above-described control operation is carried out by the above arrangements.

In this second embodiment, since the film forming apparatus 1 is controlled under optimum control conditions obtained through the simulation, the formed film is more likely to be of the desired film thickness.

Third Embodiment

In the second embodiment, the film forming apparatus 1 has been controlled by the results of simulation by the computing unit 101. Otherwise, it may be arranged such that, by executing the simulation with the control unit 110, the control conditions are calculated by simulation responsive to each of viscosity changes due to temperature as well as differences in simulation conditions among lots (viscosity of process liquid, process area, process time, film thickness).

Figure 13:
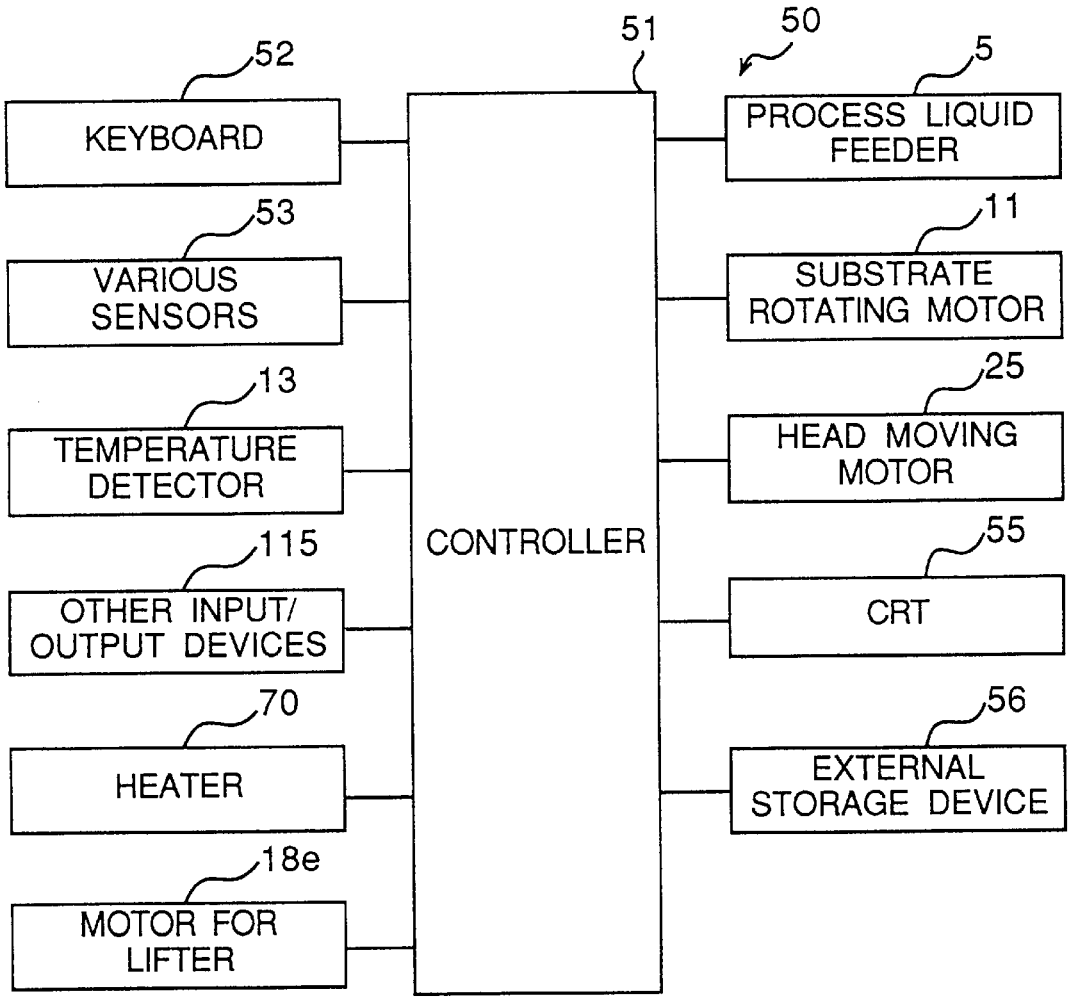
FIG. 13 is a block diagram of the control unit of a film forming apparatus according to a third embodiment of the invention.

FIG. 13 shows a control unit of the film forming apparatus according to a third embodiment of the present invention. The control unit 50 has a controller 51 comprising a microcomputer equipped with CPU, RAM, ROM, and the like. To the controller 51, are connected a keyboard 52 for entering commands or numerical values, various sensors 53 as one example of the status detecting means for detecting the status of the process liquid, such as the liquid level sensors 17*a*, 17*b*, 27 of the first embodiment, a process liquid feeder 5 for feeding the process liquid to the discharge head 4 that discharges the process liquid, a substrate rotating motor 11 for rotating the substrate 2, a head moving motor 25 for moving the discharge head 4, and the heater 70 for heating the process liquid in the head 4.

Also connected to the controller 51 are the temperature sensor 13 for detecting the temperature of the process liquid at the discharge head 4, a liquid crystal display 55 for display use, an external storage device 56 such as a device for a hard disk, and other input/output devices 115. In the ROM within the controller 51, the relationship between temperature and viscosity for each process liquid is stored in the form of a table as the first embodiment. In the external storage device 56, control conditions that have previously been determined by simulation are stored according to the simulation conditions. It is noted that the arrangement of the film forming apparatus 1 is the same as that of FIG. 1 except that the control unit is different in contents, and so its description is omitted.

Figure 14:
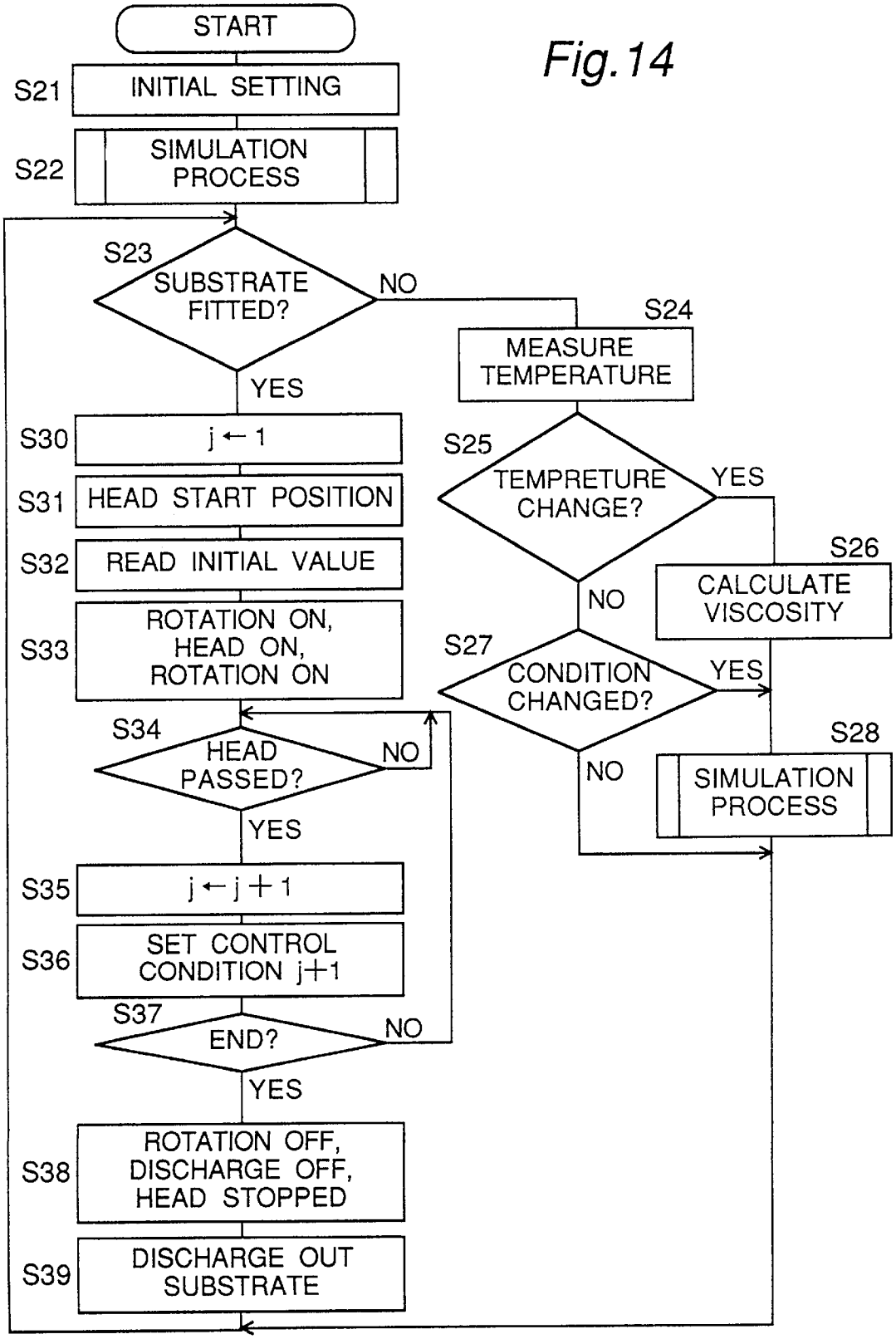
FIG. 14 is a flow chart showing the control operation of the third embodiment.

Next the control operation of the third embodiment is explained according to the control flow chart as shown in FIG. 14.

At step S21 of FIG. 14, the initial setting is executed. The initial setting in this case includes storing the table showing the relationship between temperature and viscosity stored in the ROM, and other settings. Further, the discharge head 4 is located to the retraction position. At step S22, a simulation process is executed, by which control conditions are determined. This simulation process is the same as that of steps P2 to P17 of FIG. 9. At step S23, it is decided whether or not the substrate 2 has been fitted. Unless the substrate 2 is fitted to the substrate holding plate 10, the program moves from step S23 to step S24. At step S24, a temperature measurement result of the process liquid by the temperature sensor 13 is captured. At step S25, it is decided whether or not a specified temperature change (e.g., a temperature change of 1° C. or more from reference temperature) has occurred. If a specified temperature change has occurred, the program goes to step S26. At step S26, a viscosity that has changed responsive to the temperature change is calculated from the table stored in the RAM. With the viscosity calculated, the program goes to step S28, where the simulation process is executed. In this case, in the simulation process of step S28, for the acceptance of the simulation conditions (process liquid viscosity, process area, process time, film thickness) of step P2 of FIG. 9, the calculated viscosity is automatically accepted.

If it is decided that no temperature change has occurred, the program moves from step S25 to step S27. At step S27, it is decided whether or not any change of the simulation conditions has occurred. This decision is made depending on, for example, whether or not the operator has executed a key operation corresponding to the change. If a change in the simulation conditions has occurred, the program goes to step S28, where the simulation process is executed. In the simulation process of step S28, for the acceptance of simulation conditions at step P2 of FIG. 9, simulation conditions entered through key operation are automatically accepted. By this simulation process of step S28, new control conditions are determined. If it has been decided at step S27 that no change in the simulation conditions has occurred, or if the simulation process has been completed at step S28, then the program returns to step S23. In addition, if it is decided at step S27 that a change in the simulation conditions has occurred, it is also possible that the simulation conditions of the already determined control conditions stored in the external storage device 56 are read, and that if some of the simulation conditions are the same as before, the simulation conditions are read and determined, as they are, without executing the simulation process.

If it is decided that the substrate 2 has been fitted, the program moves from step S23 to step S30. At steps S30 to S39, the same processes as in steps S4 to S13 of FIG. 12 are executed, by which the film is formed at a specified film thickness with the control conditions determined by the simulation process. Then, upon completion of the film formation, the program returns to step S23.

In this embodiment, each time the simulation conditions have undergone a change, optimum control conditions are determined in real time by the simulation process, so that the film is formed with the determined control conditions. Therefore, the resulting film is even closer to the desired film thickness.

The present invention is preferably applied, for example, to the formation of a film having a thickness of 2 to 4 $\mu$m±10% on a 5-inch (120 mm diameter) optical disk as a substrate by using ultraviolet-curing resin or thermosetting resin as the process liquid, or to the formation of a film having a thickness of 0.05 to 0.1 $\mu$m±5% on a semiconductor substrate by using resist solution as the process liquid.

Example of the Simulation

A film having a thickness of 2 to 4 $\mu$m±10% is formed on a 5-inch (120 mm diameter) optical disk by using ultraviolet curing resin or thermosetting resin as the process liquid. In this case, with the normal temperature of the process liquid being 23° C. and with a necessary temperature-control precision of 0.3 to 1° C., if the temperature sensor has detected a temperature rise beyond this precision range, continuing the application process with the temperature unchanged would result in the film becoming easily elongated such that the film thickness would be too thin. Therefore, the film is prevented from becoming too thin in film thickness by any of the following four manners:

(i) With a normal number of revolutions of the substrate being 4500 rpm, this number of revolutions is lowered so that the centrifugal force ($mr\omega^2$) is lowered, by which the film is prevented from being elongated and thus prevented from resulting in a thin film thickness;

(ii) The process time from when the process liquid is applied from the nozzle to the substrate until the applied liquid is expanded on the substrate by centrifugal force is shortened, by which the film is prevented from being elongated and thus prevented from resulting in a thin film thickness. This process time is normally 4.5 seconds in this example, which is the steady rotation duration time excluding the leading edge at the application start time and the trailing edge at the application end time, in the rotation duration time of the substrate. The process time is generally proportional to the viscosity of the process liquid;

(iii) The pressure in the reservoir 14 of the process liquid feeder is reduced so that the discharge flow velocity of the nozzles is reduced, by which the film is prevented from being elongated and thus prevented from resulting in a thin film thickness. This discharge flow velocity of the nozzles is inversely proportional to the viscosity of the process liquid; and (iv) With a normal moving speed of the nozzles being 8 mm/sec., the moving speed is increased higher than the normal moving speed, by which the film is prevented from being elongated and thus prevented from resulting in a thin film thickness. This moving speed of the nozzles is inversely proportional to the discharge flow rate from the nozzles.

Conversely, when the temperature of the process liquid has lowered below the permissible precision range, the temperature of the process liquid within the discharge nozzles is increased by the heater 70. The relationship between temperature and viscosity of the process liquid is such that if the temperature is 23° C., for example, then the viscosity is 22 cps, making a relationship of 1 to 2 cps/°C. holding. In increasing the temperature of the process liquid by the heater, since the process liquid temperature will not be increased immediately by the heater, it may also be arranged such that operations reverse to the above operations (1) to (4) are conducted for earlier stages, and then switched to the heating by the heater. That is, it is possible to use combinations of several processing means.

Other Modifications (a) The determination of control conditions may be decided by the operator from the film thicknesses calculated through the simulation, other than being automatically decided by the computer 102.

(b) Responsive to a movement of the discharge head 4, instead of simultaneously controlling both the rotation of the substrate 2 and the movement of the head 4, either one of them may be controlled. Also, the feed quantity of the process liquid feeder 5 may be controlled responsive to a movement of the discharge head 4. In this case, the feed quantity needs to be increased responsive to the movement of the discharge head 4.

(c) The present invention may be applied also to the case where the film is formed with an ordinary bored nozzle in place of the ink jet system nozzle.

(d) The present invention may be applied also to the case where the film is formed along a specified curve to make the film thickness different without making the film thickness uniform.

In the foregoing embodiments, the timing at which the simulation is executed is exemplified as below:

(1) Each time the process liquid is applied to one substrate 2, the simulation is executed for the film formation of the next substrate 2;

(2) The simulation is executed for the film formation of every specified number of substrates 2;

(3) While the state of the film formed on the substrate is monitored, the simulation is executed at the time when the film thickness is about to go out of the film thickness permissible range; and (4) When defective products are generated such that the film formed on the substrate 2 falls out of the permissible range, the simulation is executed for the film formation of the next substrate 2.

With the method for determining film thickness control conditions according to the present invention, the behavior of the process liquid on the substrate is simulated by varying at least one of the number of revolutions of the substrate, the rotation duration time of the substrate, the moving speed of the nozzles, the discharge flow velocity of the nozzles, and the temperature of the process liquid, by which film thicknesses at classified unitary positions are calculated. Therefore, without executing actual application, control conditions for obtaining an optimum film thickness can be determined in short time by simulation results.

With the film forming apparatus according to the present invention, at least any of the five means is controlled with optimum conditions obtained by executing the simulation process. Therefore, a film close to a desired film can be formed easily.

Although the present invention has been fully described in connection with the preferred embodiments thereof with reference to the accompanying drawings, it is to be noted that various changes and modifications are apparent to those skilled in the art. Such changes and modifications are to be understood as being included within the scope of the present invention as defined by the appended claims.

What is claimed is:

1. A method for determining film thickness control conditions for use in forming a film of a predetermined thickness on a substrate, wherein the substrate is rotated and a process liquid is discharged towards the rotating substrate from nozzles moving in a radial direction from a center of the substrate, wherein the film thickness control conditions comprise a number of revolutions of the rotating substrate, a rotation duration time of the rotating substrate, a moving speed of the nozzles, a discharge flow velocity of the nozzles, and a temperature of the process liquid, said method comprising:

an information receiving step for receiving data of a desired film thickness and a viscosity of the process liquid;

a simulation step for, using the data of the desired film thickness and the viscosity of the process liquid received in said information receiving step, simulating a variation of at least one of the film thickness control conditions for each of predetermined unitary positions on the substrate each defined by an area of a ring which encircles the center of the substrate, simulating a behavior of the process liquid on the substrate, and calculating a film thickness for each of the predetermined unitary positions;

a control condition determining step for determining the film thickness control conditions based on the at least one of the film thickness control conditions which were varied in said simulation step and based on the film thicknesses calculated in said simulation step;

a detecting step for detecting an actual temperature of the process liquid prior to discharging the process liquid onto the substrate;

a changing step for changing the film thickness control conditions such that, when the detected actual temperature of the process liquid does not yield a viscosity equal to the viscosity received in said information receiving step, either the discharge flow velocity of the nozzles or the moving speed of the nozzles is changed in accordance with the detected actual temperature of the process liquid, and at least one of a rotation duration time of the substrate and the number of revolutions of the substrate is changed in accordance with the detected actual temperature of the process liquid; and a film forming step for forming a film of the predetermined thickness on the substrate by rotating the substrate, discharging the process liquid onto the rotating substrate from nozzles, and moving the nozzles in a radial direction from a center of the substrate according to the film thickness control conditions;

wherein either the rotation duration time of the substrate or the moving speed of the nozzles is set to decrease as the nozzles move from the center of the substrate to a periphery of the substrate.

2. A method as claimed in claim 1, wherein:

said information receiving step further comprises receiving data of a discharge time of the nozzles and an application area of the process liquid; and said simulation step comprises, using the data of the desired film thickness, the viscosity of the process liquid, the discharge time of the nozzles, and the application area of the process liquid received in said information receiving step, simulating the variation of the at least one of the film thickness control conditions for each of the predetermined unitary positions, simulating the behavior of the process liquid on the substrate, and calculating the film thickness for each of the predetermined unitary positions.

3. A method as claimed in claim 1, wherein said simulation step further comprises:

a setting step for setting the nozzles' application start and end positions as being located on the substrate at radial positions from the center of the substrate, and for setting an initial value for at least one of the film thickness control conditions;

an application quantity calculation step for calculating, using the data of the desired film thickness and the viscosity of the process liquid received in said information receiving step, an amount of the process liquid discharged from the nozzles for each of the predetermined unitary positions over a range from the application start position to the end position while at least one of the film thickness control conditions is varied using data obtained from one of a plurality of data curves each comprising predetermined film thickness control conditions; and a spreading quantity calculation step for calculating an amount of the process liquid, from the calculated amount of the process liquid discharged from the nozzles in said application quantity calculation step, that has spread into and out of the predetermined unitary positions;

wherein said calculation of the film thickness for each of the predetermined radial sections in said simulation step is based on the calculation performed in said application quantity calculation step and the calculation performed in said spreading quantity calculation step; and wherein said application quantity calculation step, said spreading quantity calculation step, and the calculation of the film thickness performed in said simulation step is repeated for each of the plurality of data curves.

4. An apparatus for forming a film of a predetermined thickness on a substrate by discharging a process liquid towards the substrate while the substrate is rotated, said apparatus comprising:

substrate holding means for supporting and rotating the substrate;

a discharge head comprising nozzles for discharging the process liquid towards the substrate;

process liquid feeding means for feeding the process liquid to said discharge head;

head moving means for moving said discharge head along a predetermined moving direction;

control condition determining means for determining film thickness control conditions, which comprise a number of revolutions of the rotating substrate, a rotation duration time of the rotating substrate, a moving speed of the nozzles, a discharge flow velocity from the nozzles, and a temperature of the process liquid, based on a simulation of a behavior of the process liquid on the substrate;

control means for controlling at least one of said substrate holding means, said head moving means, and said process liquid feeding means based upon the film thickness control conditions determined by said control condition determining means; and detecting means for detecting an actual temperature of the process liquid prior to discharging the process liquid onto the substrate;

wherein said control means is operable to have the film thickness control conditions changed such that either the discharge flow velocity of said nozzles or the moving speed of the nozzles is changed in accordance with the detected actual temperature of the process liquid, and at least one of a rotation duration time of the substrate and the number of revolutions of the substrate is changed in accordance with the actual temperature of the process liquid detected by said detecting means; and wherein either the rotation duration time of the substrate or the moving speed of said nozzles is set to decrease as said nozzles move from the center of the substrate to a periphery of the substrate.

5. An apparatus as claimed in claim 4, wherein said control condition determining means comprises:

information receiving means for receiving data of a desired film thickness and a viscosity of the process liquid;

simulation means for, using the data of the desired film thickness and the viscosity of the process liquid received by said information receiving means, simulating a variation of at least one of the film thickness control conditions for each of predetermined unitary positions on the substrate each defined by an area of a ring which encircles the center of the substrate, simulating the behavior of the process liquid on the substrate, and calculating a film thickness for each of the predetermined unitary positions;

control condition acquisition means for acquiring the film thickness control conditions based on the at least one of the film thickness control conditions which were varied by said simulation means and based on the film thicknesses calculated by said simulation means.

6. An apparatus as claimed in claim 5, wherein:

said information receiving means further receives data of a discharge time of the nozzles and an application area of the process liquid; and said simulation means, using the data of the desired film thickness, the viscosity of the process data, the discharge time of the nozzles, and the application area of the process liquid received by said information receiving means, simulates the variation of at least one of the film thickness control conditions for each of the predetermined unitary positions, simulates the behavior of the process liquid on the substrate, and calculates the film thickness for each of the predetermined unitary positions.

7. An apparatus as claimed in claim 5, wherein said simulation means further comprises:

setting receiving means for receiving settings of the nozzles application start and end positions which are located on the substrate at radial positions from the center of the substrate, and for setting an initial value for at least one of the film thickness control conditions;

application quantity calculation means for calculating, using the data of the desired film thickness and the viscosity of the process liquid received by said information receiving means, an amount of process liquid discharged from the nozzles for each of the predetermined unitary positions over a range from the application start position to the end position while at least one of the film thickness control conditions is varied using data obtained from one of a plurality of data curves each comprising predetermined film thickness control conditions;

a spreading quantity calculation means for calculating an amount of the process liquid, from the calculated amount of the process liquid discharged from the nozzles in said application quantity calculation means, that has spread into and out of the predetermined unitary positions;

film thickness calculation means for calculating the film thickness for each of the predetermined unitary positions based on the calculation performed in said application quantity calculation means and the calculation performed in said spreading quantity calculation means;

repeating means for repeating the operations performed by said application quantity calculation means, said spreading quantity calculation means, and said film thickness calculation means for each of the plurality of data curves.

8. An apparatus as claimed in claim 4, wherein said nozzles are positioned at predetermined intervals and said nozzles are positioned so as to discharge the process liquid in one direction.

9. An apparatus as claimed in claim 4, wherein said nozzles are of an ink jet system.

* * * * *